US012304718B2

(12) United States Patent
Narahara et al.

(10) Patent No.: US 12,304,718 B2
(45) Date of Patent: May 20, 2025

(54) LOW-TEMPERATURE TRANSPORT DEVICE AND PRODUCTION METHOD THEREFOR, AND USE THEREOF

(71) Applicants: KANEKA CORPORATION, Osaka (JP); TAMAIKASEI CO., LTD., Hokkaido (JP)

(72) Inventors: Risa Narahara, Osaka (JP); Keiji Sato, Hokkaido (JP)

(73) Assignees: KANEKA CORPORATION, Osaka (JP); TAMAIKASEI CO., LTD., Hokkaido (JP)

( * ) Notice: Subject to any disclaimer, the term of this patent is extended or adjusted under 35 U.S.C. 154(b) by 190 days.

(21) Appl. No.: 18/089,317

(22) Filed: Dec. 27, 2022

(65) Prior Publication Data

US 2023/0137817 A1 May 4, 2023

Related U.S. Application Data

(63) Continuation of application No. PCT/JP2021/022039, filed on Jun. 10, 2021.

(30) Foreign Application Priority Data

Jun. 30, 2020 (JP) ..... 2020-113400
Nov. 10, 2020 (JP) ..... 2020-187585

(51) Int. Cl.
*B65D 81/18* (2006.01)
*B65D 81/38* (2006.01)
*F25D 3/14* (2006.01)

(52) U.S. Cl.
CPC ..... *B65D 81/18* (2013.01); *B65D 81/3816* (2013.01); *F25D 3/14* (2013.01)

(58) Field of Classification Search
CPC ..... F25D 3/125; F25D 3/14; F25D 2303/081; F25D 3/08; F25D 2303/082; F25D 2303/0845; B65D 81/3816; B65D 81/18
See application file for complete search history.

(56) References Cited

U.S. PATENT DOCUMENTS 3,810,367 A 5/1974 Peterson
4,134,276 A * 1/1979 Lampard ..... F25D 3/125 62/383

(Continued)

FOREIGN PATENT DOCUMENTS

JP S48057764 U 7/1973
JP S60038266 U 3/1985

(Continued)

OTHER PUBLICATIONS

Extended European Search Report issued in corresponding European Application No. 21833008.2 mailed Jun. 10, 2024 (8 pages).

(Continued)

*Primary Examiner* — Frantz F Jules
*Assistant Examiner* — Martha Tadesse
(74) *Attorney, Agent, or Firm* — Osha Bergman Watanabe & Burton LLP

(57) ABSTRACT

A low-temperature transport device is for the purpose of transporting a transport object in a state in which the transport object is kept at a low temperature for a long period of time. The low-temperature transport device includes a thermal insulation container, a plurality of pieces of dry ice disposed in the thermal insulation container so as to cool a transport object, a support member disposed in the thermal insulation container to support the transport object, and a first space formed between the transport object supported by (Continued)

the support member and an inner bottom surface of the thermal insulation container. The first space is filled with the dry ice.

10 Claims, 15 Drawing Sheets

(56) References Cited

U.S. PATENT DOCUMENTS

| | | | | |
|---|---|---|---|---|
| 4,288,996 | A * | 9/1981 | Roncaglione | F25D 3/14 73/40 |
| 4,377,075 | A * | 3/1983 | Russo | F25D 3/14 62/530 |
| 4,862,674 | A * | 9/1989 | Lejondahl | B65D 81/386 53/399 |
| 6,089,038 | A * | 7/2000 | Tattam | B65D 81/3888 62/457.2 |
| 9,629,488 | B1 | 4/2017 | Mathis | |
| 2016/0114326 | A1* | 4/2016 | Schryver | B01L 7/50 62/465 |

FOREIGN PATENT DOCUMENTS

| | | | |
|---|---|---|---|
| JP | S60113481 | U | 7/1985 |
| JP | S62193978 | A | 8/1987 |
| JP | S63022581 | U | 2/1988 |
| JP | S63149874 | U | 10/1988 |
| JP | H01114576 | U | 8/1989 |
| JP | 2004196410 | A | 7/2004 |
| JP | 2006219173 | A | 8/2006 |
| JP | 2008116165 | A | 5/2008 |

OTHER PUBLICATIONS

International Search Report issued in corresponding International Application No. PCT/JP2021/022039; mailed Aug. 3, 2021 (7 pages).

International Preliminary Report on Patentability issued in corresponding International Application No. PCT/JP2021/022039; dated Dec. 13, 2022 (13 pages).

* cited by examiner

Device configurations

LOW-TEMPERATURE TRANSPORT DEVICE AND PRODUCTION METHOD THEREFOR, AND USE THEREOF

TECHNICAL FIELD

One or more embodiments of the present invention relate to a low-temperature transport device, a method for producing the low-temperature transport device, and a use of the low-temperature transport device.

BACKGROUND

For example, the device disclosed in Patent Literature 1 is known as the conventional low-temperature transport device for transporting a transport object while cooling the object with use of dry ice. The low-temperature transport device disclosed in Patent Literature 1 is configured such that dry ice is disposed in a thermal insulation container so as to keep a transport object cool. The dry ice disposed in the thermal insulation container is configured such that a dry ice group of a large number of dry ice pellets and plate-shaped dry ice which is a lump of dry ice larger than the dry ice pellets coexist in the thermal insulation container.

PATENT LITERATURE

Patent Literature 1

Japanese Patent Application Publication Tokukai No. 2008-116165

However, the low-temperature transport device disclosed in Patent Literature 1 has room for improvement in terms of how to keep a transport object at a low temperature for a long period of time.

SUMMARY

An aspect of one or more embodiments of the present invention is to achieve a low-temperature transport device which enables a transport object to be transported in a state in which the transport object is kept at a low temperature for a long period of time, a method for producing the low-temperature transport device, and a use of the low-temperature transport device.

In order to attain the foregoing object, a low-temperature transport device in accordance with an aspect of one or more embodiments of the present invention includes: a thermal insulation container including a container body and a lid for closing an opening of the container body; dry ice disposed in the thermal insulation container so as to cool a transport object; a support member disposed in the thermal insulation container to support the transport object; and a first space formed between the transport object supported by the support member and an inner bottom surface of the thermal insulation container, the first space being filled with the dry ice.

Advantageous Effects of Invention

According to an aspect of one or more embodiments of the present invention, it is possible to transport a transport object in a state in which the transport object is kept at a low temperature for a long period of time.

Figure 2A:
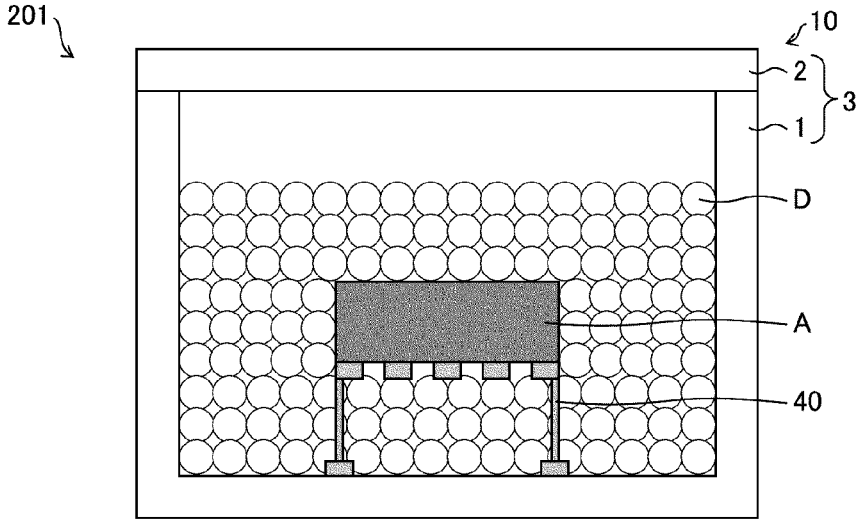
Figure 2B:
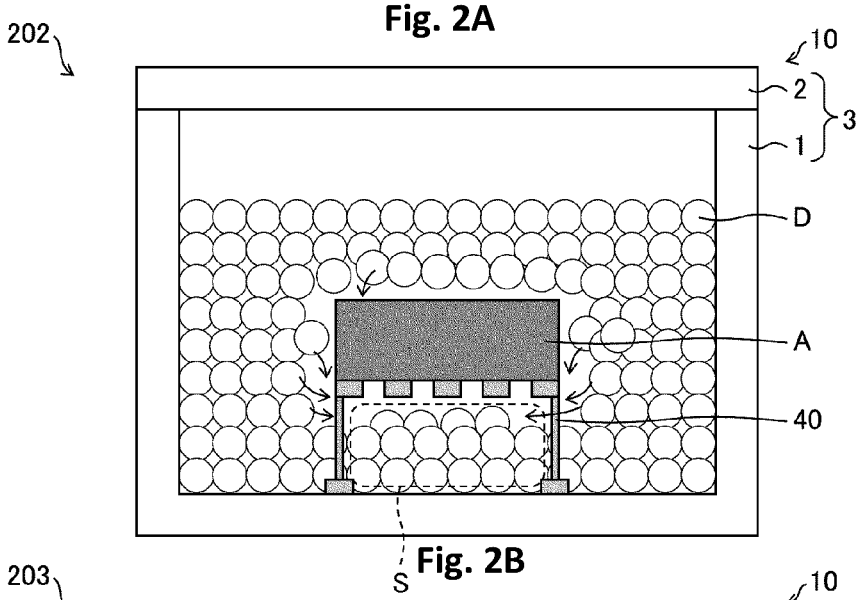
Figure 2C:
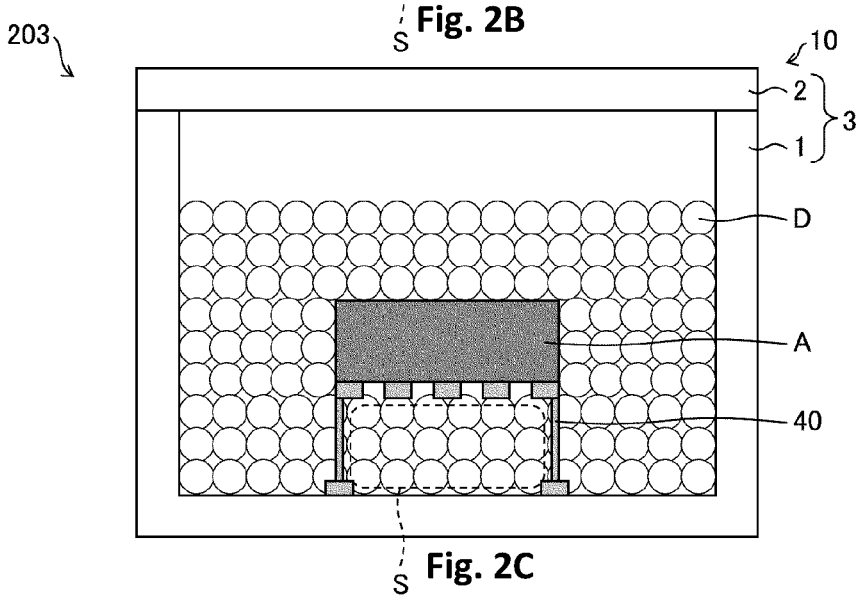

Each of 201 to 203 of FIGS. 2A-C is a view for describing an operation and effect of the low-temperature transport device.

Figure 3A:
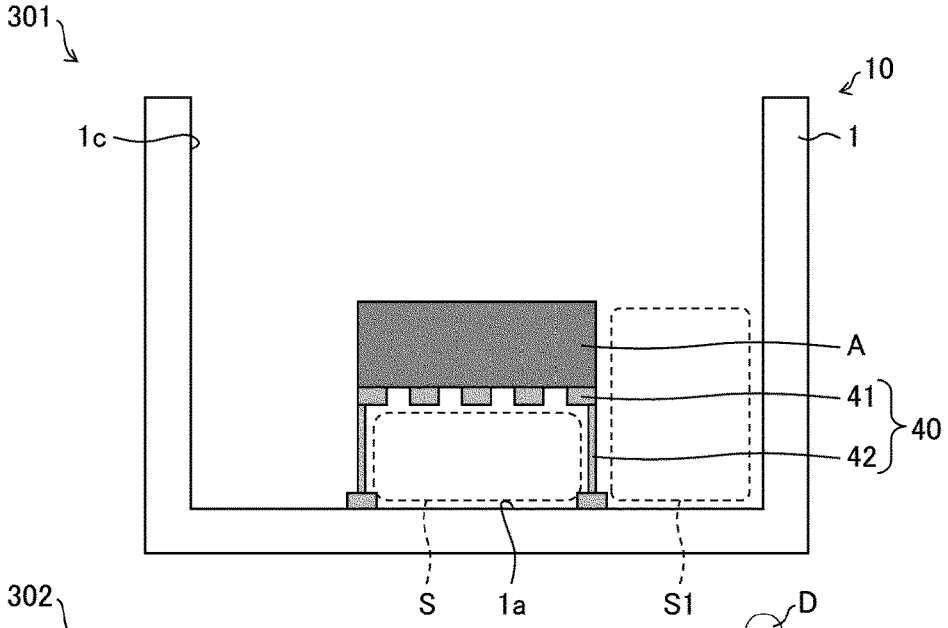
Figure 3B:
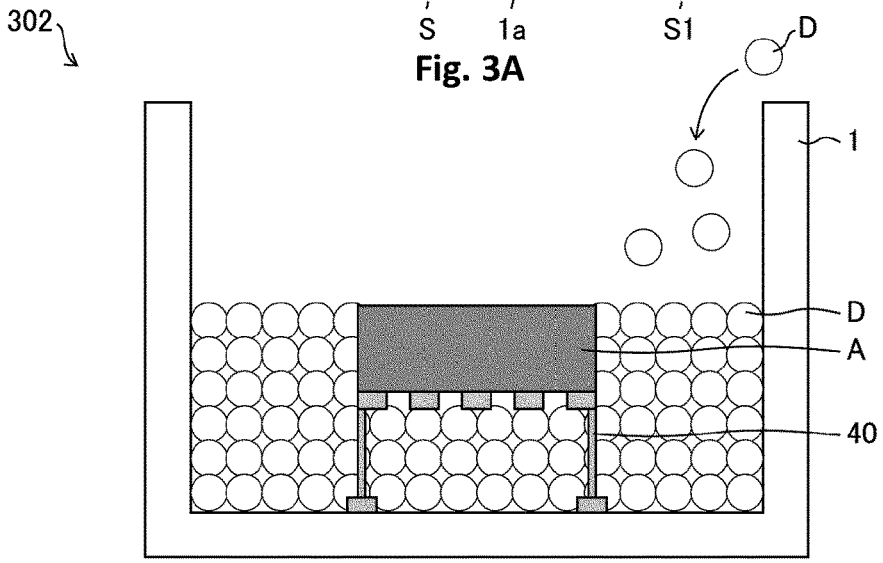
Figure 3C:
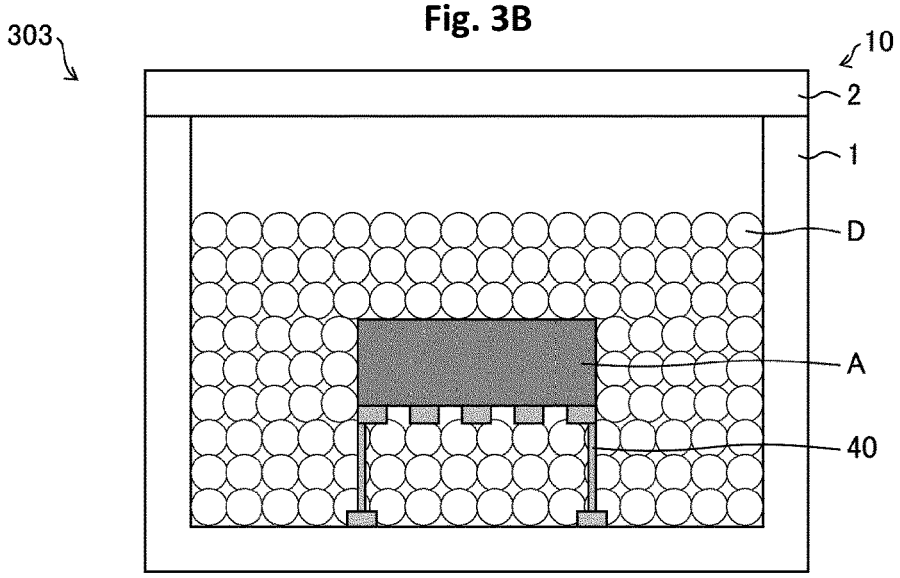

Each of 301 to 303 of FIGS. 3A-C is a cross-sectional view illustrating an example of a method for producing the low-temperature transport device.

Figure 4A:
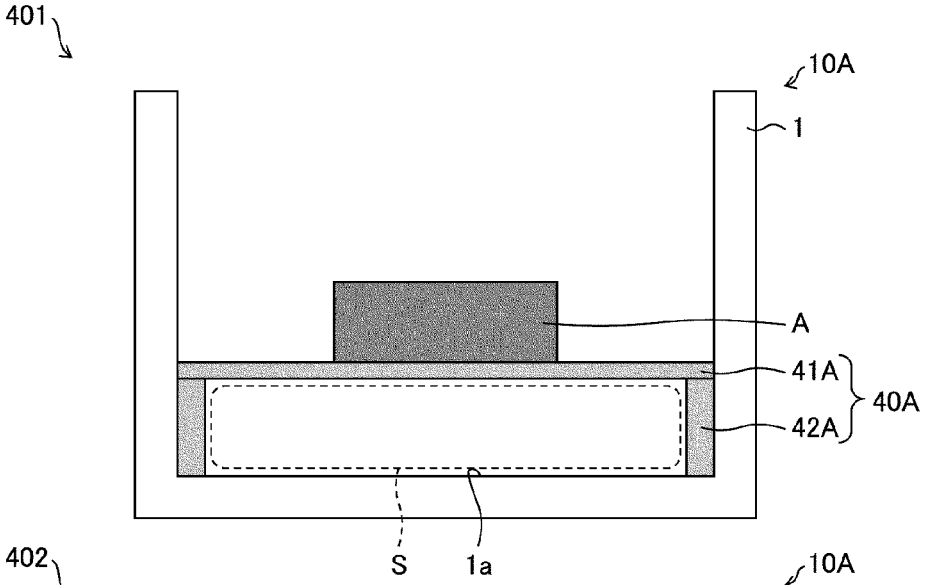
Figure 4B:
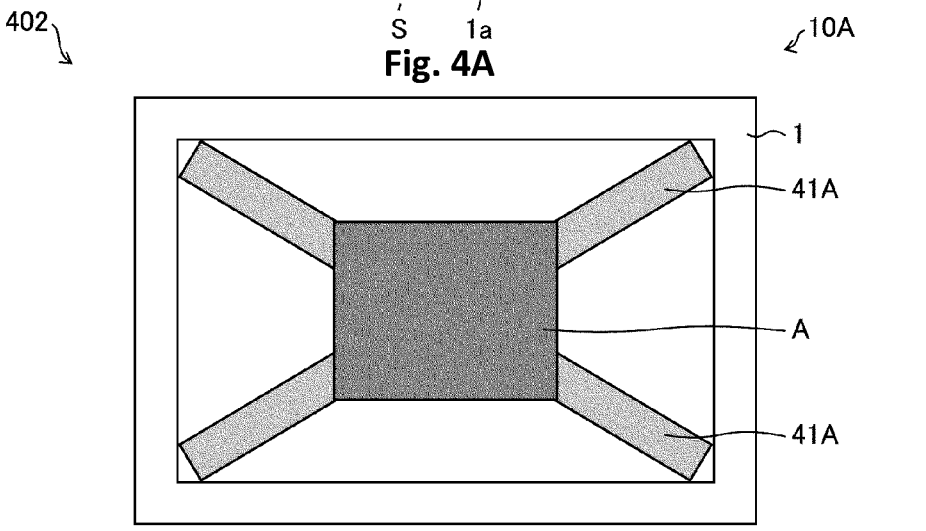

FIGS. 4A-B schematically illustrate a configuration of a low-temperature transport device of Variation 1. 401 of FIG. 4A is a cross-sectional view, and 402 of FIG. 4B is a top view illustrating an inside of the device.

Figure 5A:
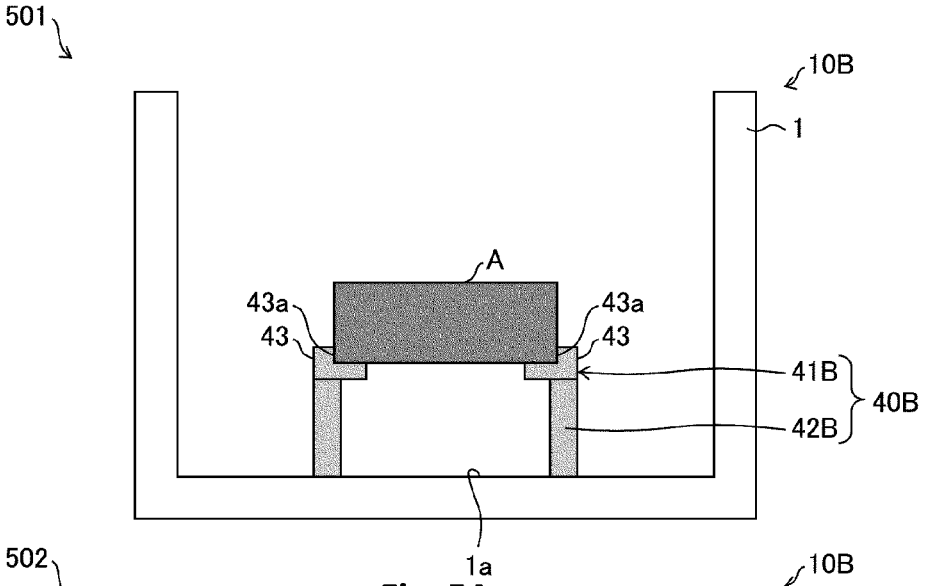
Figure 5B:
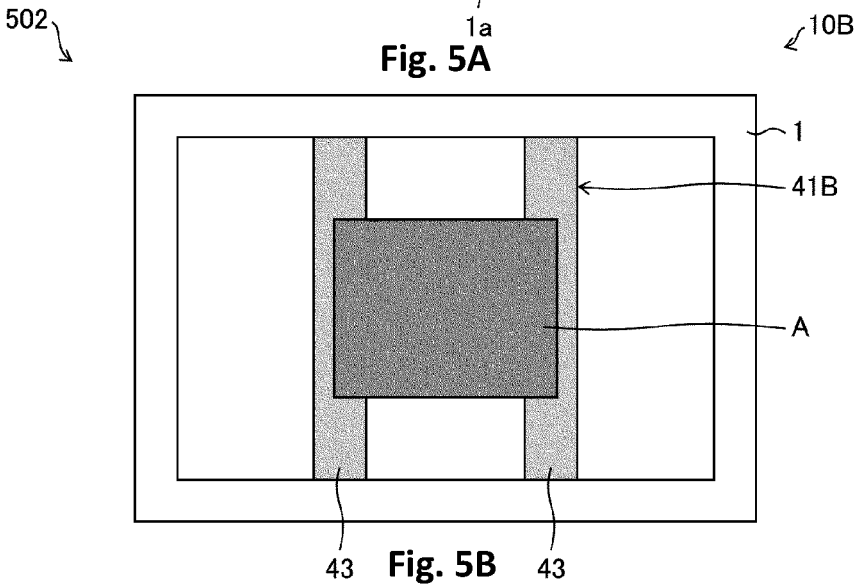

FIGS. 5A-B schematically illustrate a configuration of a low-temperature transport device of Variation 2. 501 of FIG. 5A is a cross-sectional view, and 502 of FIG. 5B is a top view illustrating an inside of the device.

Figure 6A:
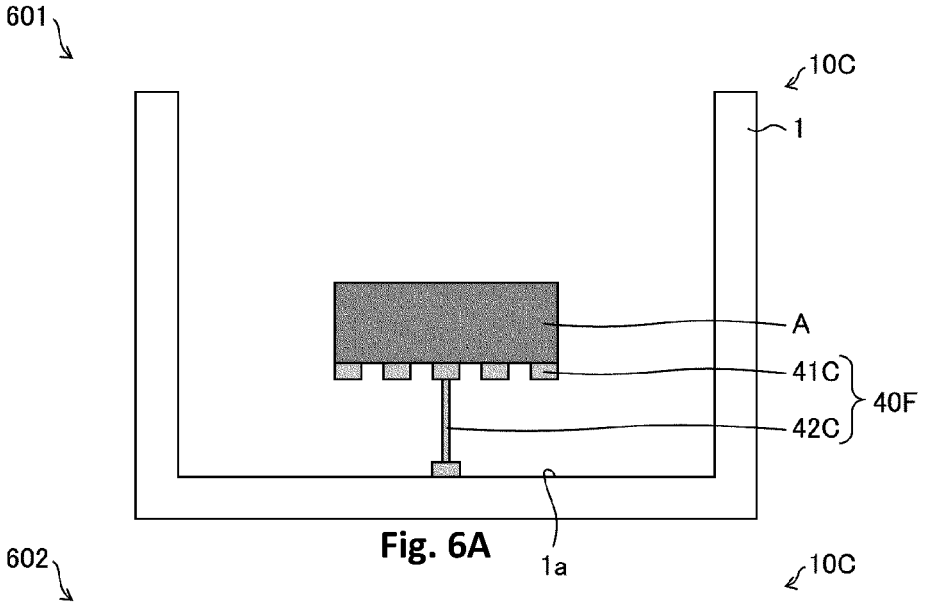
Figure 6B:
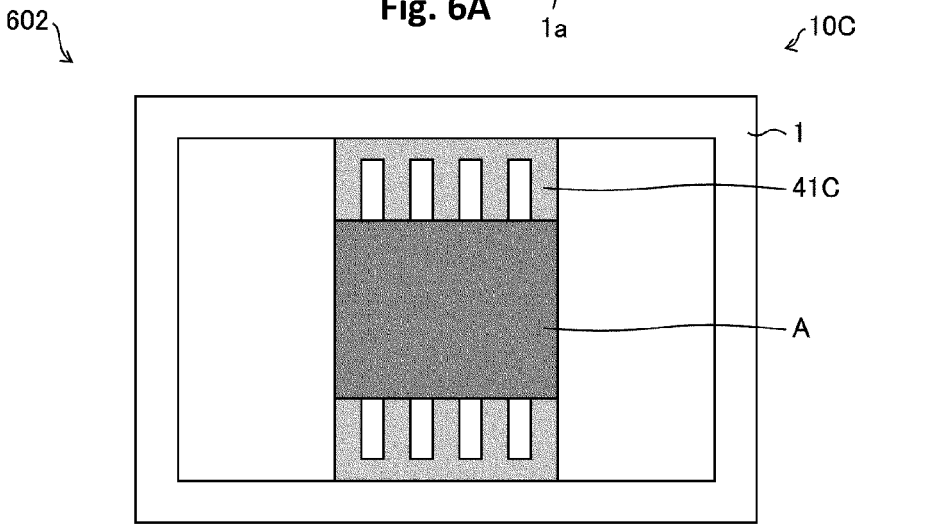

FIGS. 6A-B schematically illustrate a configuration of a low-temperature transport device of Variation 3. 601 of FIG. 6A is a cross-sectional view, and 602 of FIG. 6B is a top view illustrating an inside of the device.

Figure 7A:
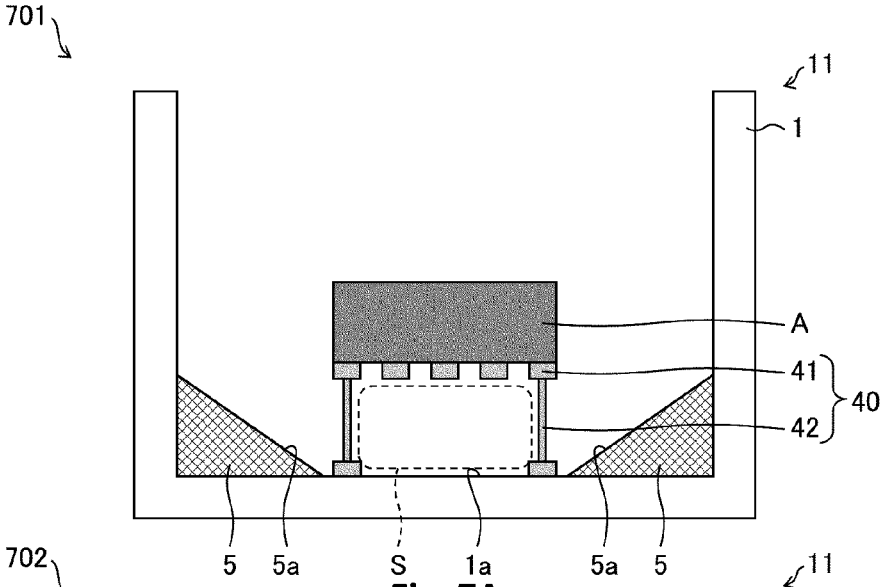
Figure 7B:
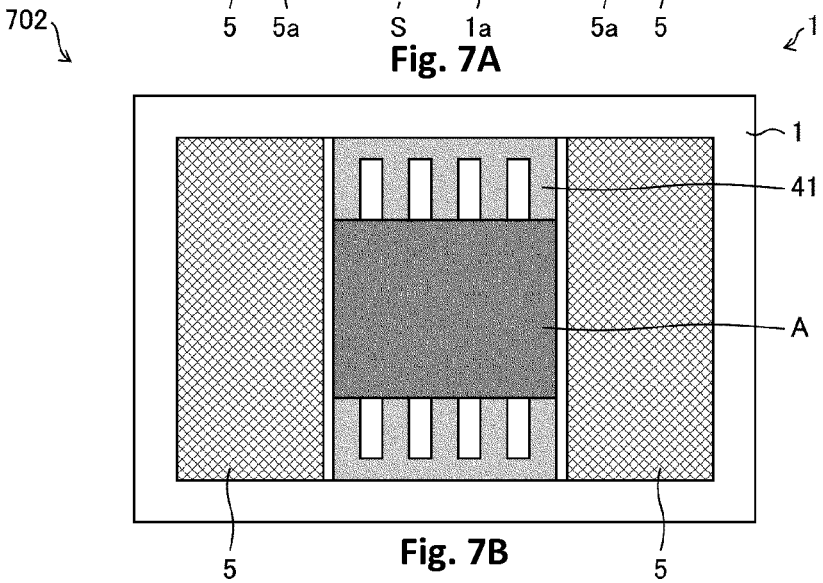

FIGS. 7A-B schematically illustrate a configuration of a low-temperature transport device in accordance with Embodiment 2 of one or more embodiments of the present invention. 701 of FIG. 7A is a cross-sectional view, and 702 of FIG. 7B is a top view illustrating an inside of the device.

Figure 8A:
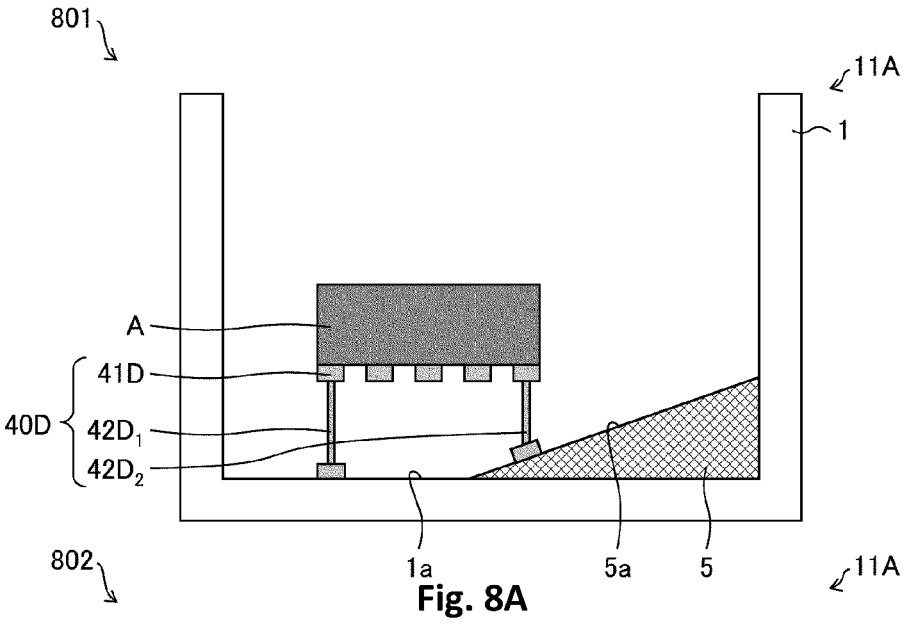
Figure 8B:
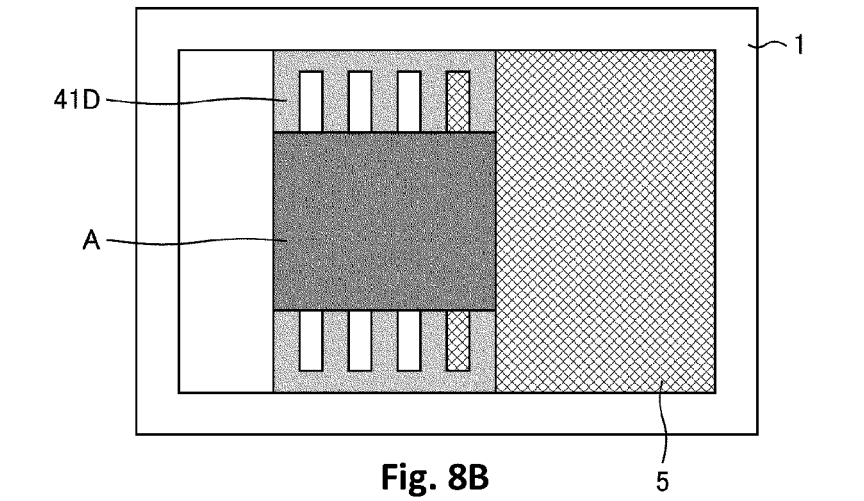

FIGS. 8A-B schematically illustrate a configuration of a low-temperature transport device of Variation 4. 801 of FIG. 8A is a cross-sectional view, and 802 of FIG. 8B is a top view illustrating an inside of the device.

Figure 9A:
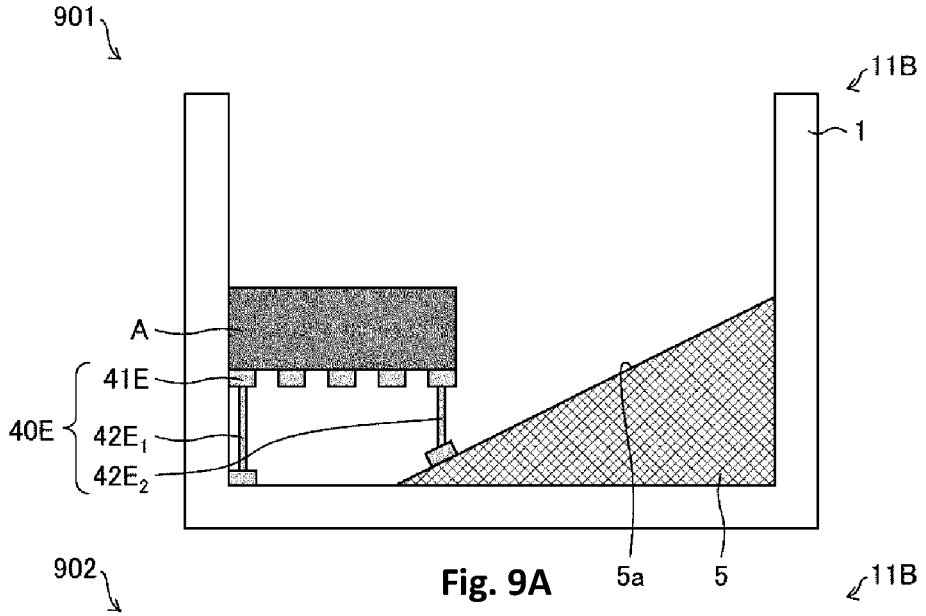
Figure 9B:
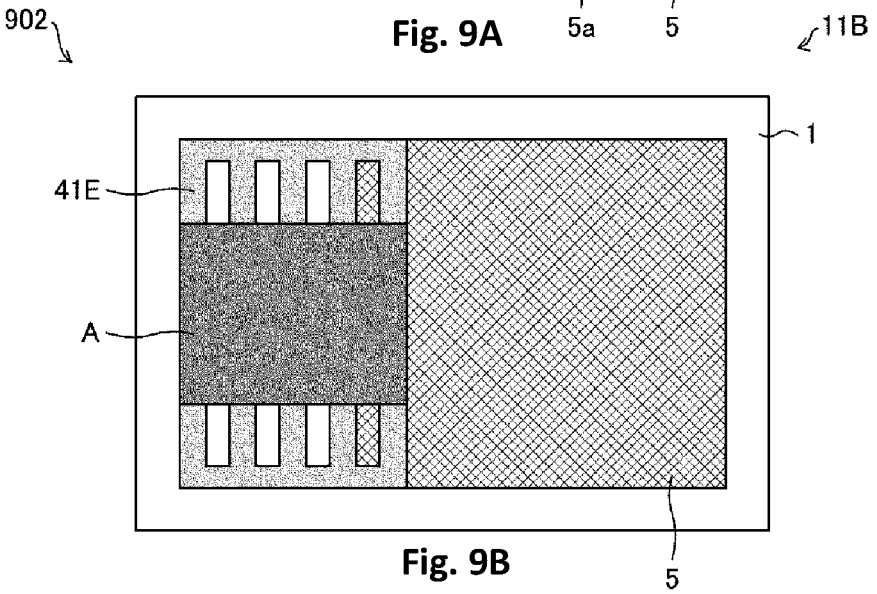

FIGS. 9A-B schematically illustrate a configuration of a low-temperature transport device of Variation 5. 901 of FIG. 9A is a cross-sectional view, and 902 of FIG. 9B is a top view illustrating an inside of the device.

Figure 10A:
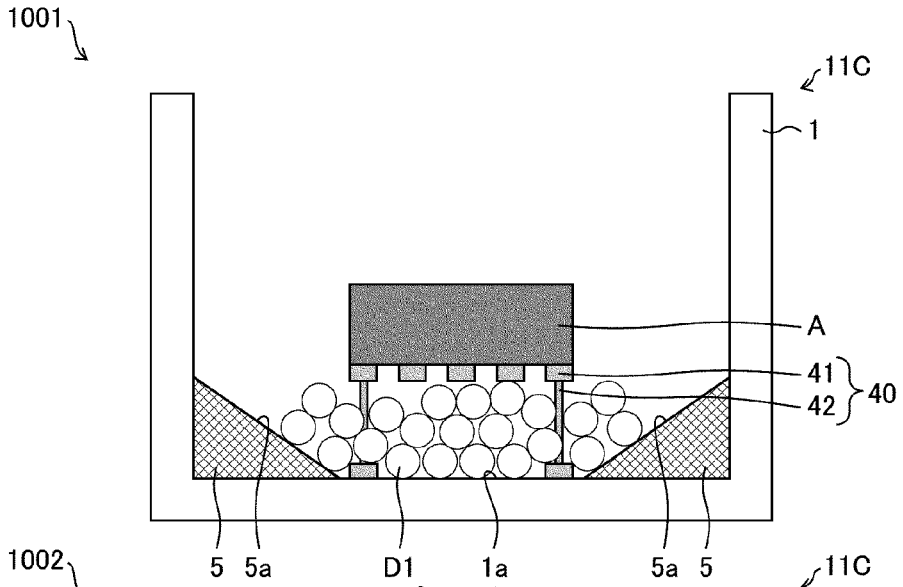
Figure 10B:
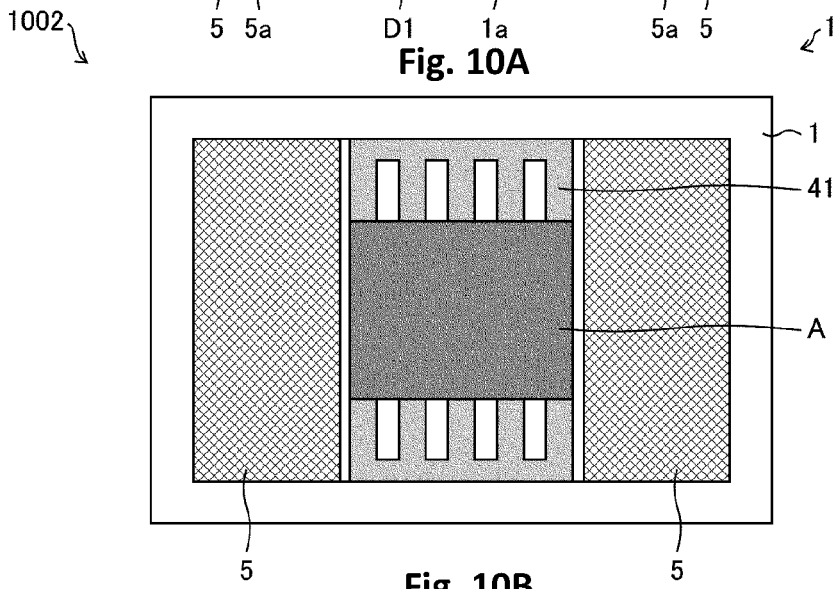

FIGS. 10A-B schematically illustrate a configuration of a low-temperature transport device of Variation 6. 1001 of FIG. 10A is a cross-sectional view, and 1002 of FIG. 10B is a top view illustrating an inside of the device.

Figure 11A:
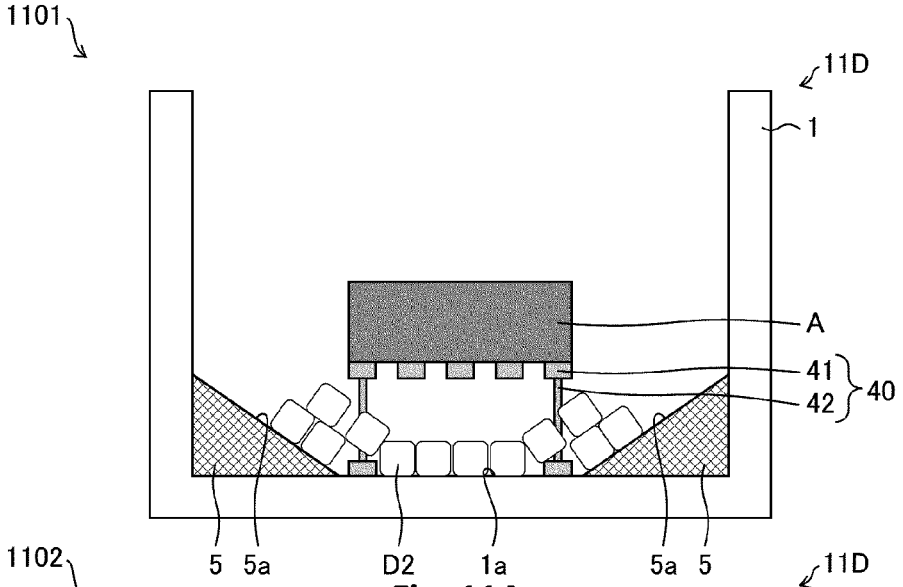
Figure 11B:
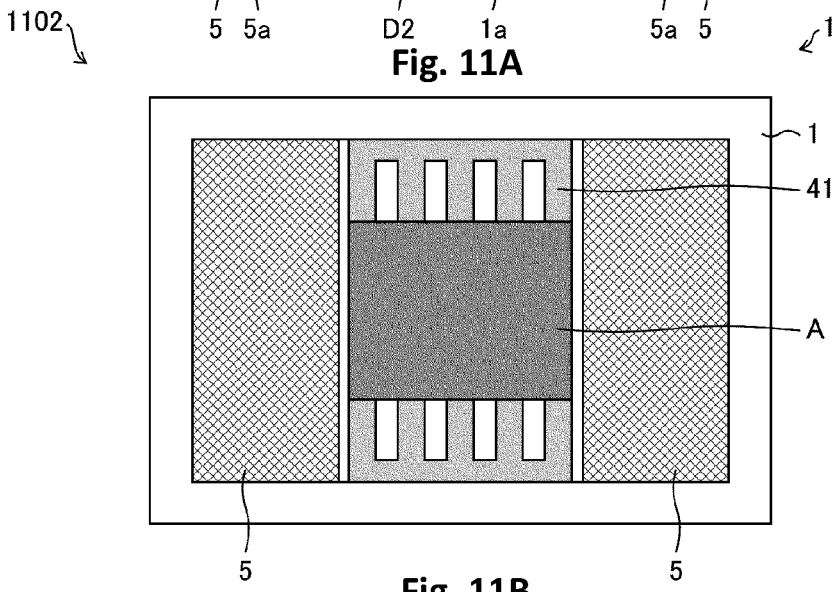

FIGS. 11A-B schematically illustrate a configuration of a low-temperature transport device of Variation 7. 1101 of FIG. 11A is a cross-sectional view, and 1102 of FIG. 11B is a top view illustrating an inside of the device.

Figure 12:
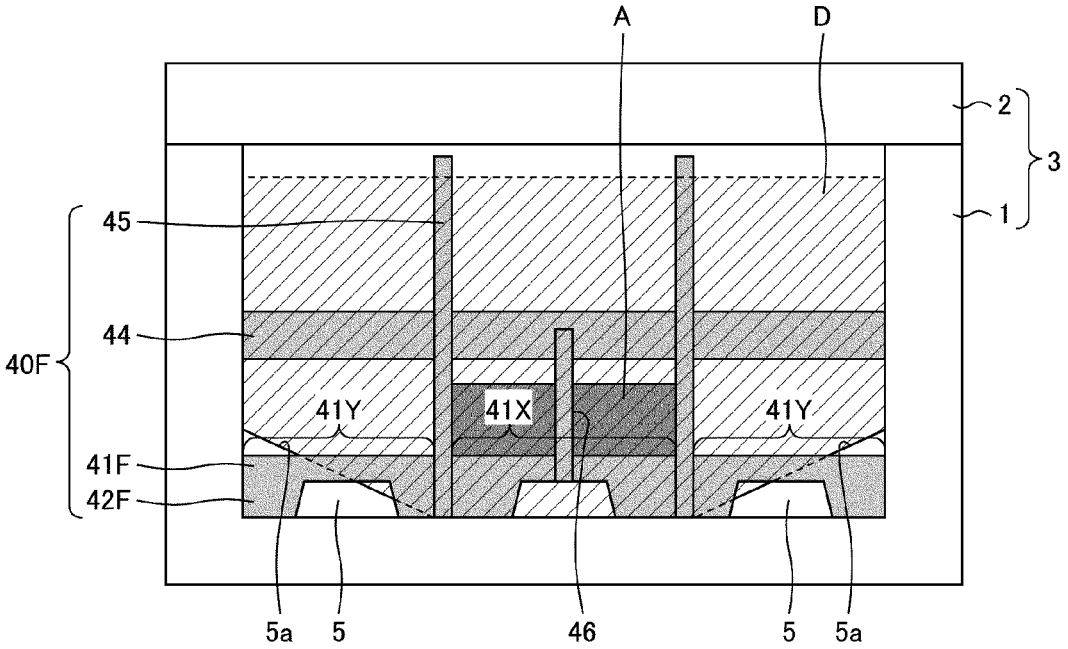

FIG. 12 is a cross-sectional view illustrating a specific configuration of a low-temperature transport device.

Figure 13A:
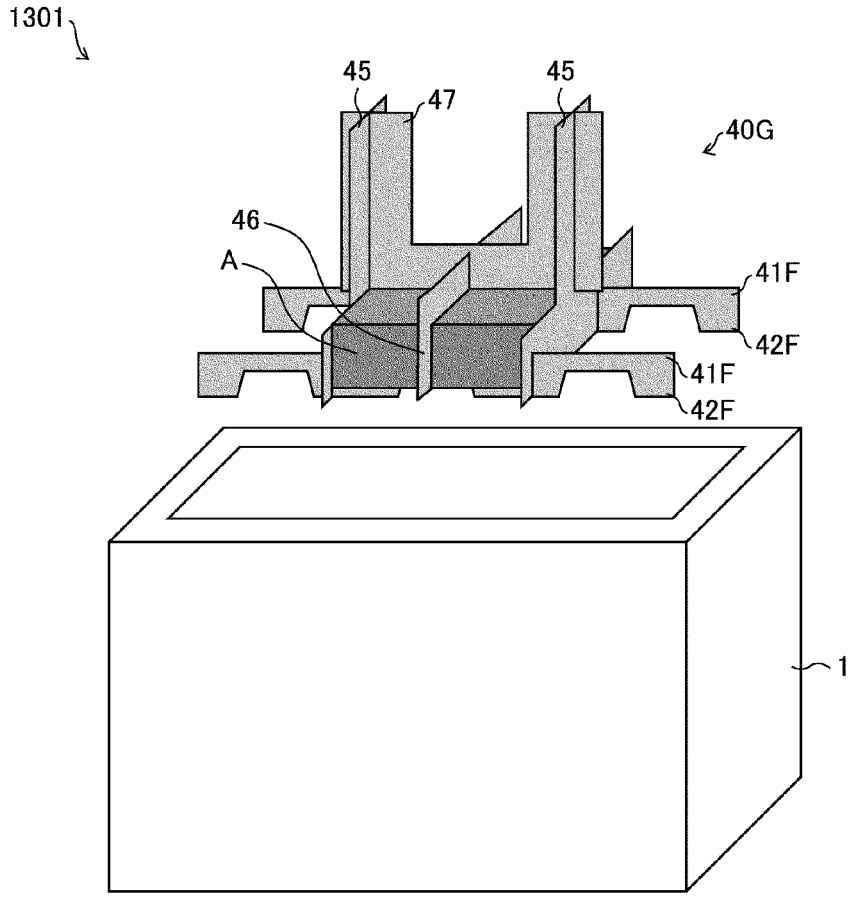
Figure 13B:
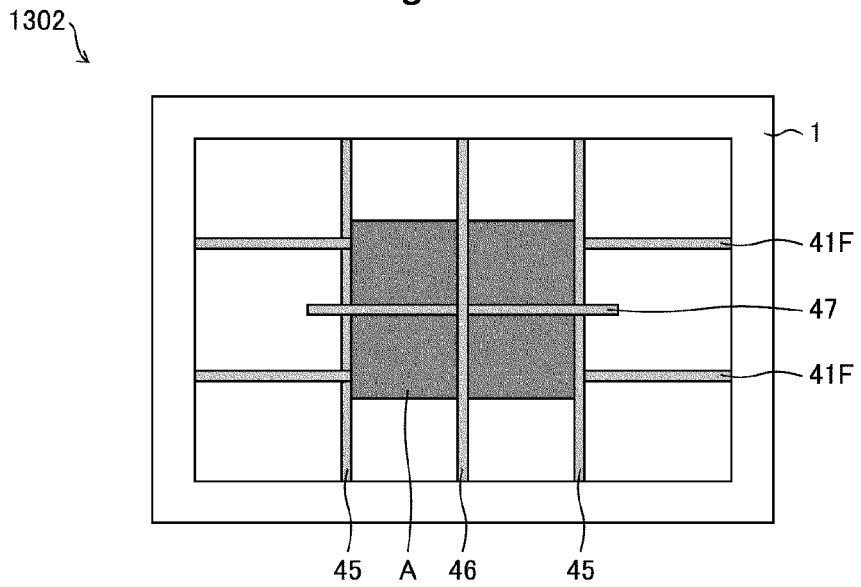

FIGS. 13A-B illustrate a variation of the low-temperature transport device illustrated in FIG. 12. 1301 of FIG. 13A is a perspective view, and 1302 of FIG. 13B is a top view.

FIGS. 14A-E are a view showing device configurations of Examples and Comparable Examples and an experimental result.

DETAILED DESCRIPTION OF THE EMBODIMENTS

Overview of Embodiment of Present Invention

In the low-temperature transport device disclosed in Patent Literature 1, dry ice is disposed in heat transfer contact with only a top surface and side surfaces of a transport object in a thermal insulation container. In addition, a bottom surface of the transport object is in contact with an inner bottom surface of the thermal insulation container. That is, in the low-temperature transport device in accordance with the embodiment of Patent Literature 1, the dry ice is absent between the bottom surface of the transport object and the inner bottom surface of the thermal insulation container. In such an arrangement of the dry ice, cool air from the dry ice does not spread to the bottom surface of the transport object. As a result, the inventors of one or more embodiments of the present invention found, through their own study, that the low-temperature transport device disclosed in Patent Literature 1 makes it difficult to thoroughly spread the cool air from the dry ice all over the transport object, and thus, in some cases, cannot keep the transport object at a low temperature for a long period of time.

To solve the foregoing issue, a low-temperature transport device in accordance with the present embodiment is configured such that (i) a position of the transport object is fixed by a support member so that the bottom surface of the transport object and the inner bottom surface of the thermal insulation container are separated, and (ii) a space between the bottom surface of the transport object and the inner bottom surface of the thermal insulation container is filled with dry ice. That is, the low-temperature transport device in accordance with the present embodiment is configured to include: a thermal insulation container including a container body and a lid for closing an opening of the container body; dry ice disposed in the thermal insulation container so as to cool a transport object; a support member disposed in the thermal insulation container to support the transport object; and a space formed between the transport object supported by the support member and an inner bottom surface of the thermal insulation container, the space being filled with the dry ice.

According to the above-described configuration, the dry ice is disposed on or around all outer surrounding surfaces, including a top surface, side surfaces, and a bottom surface, of the transport object. Thus, the cool air of the dry ice spreads all over the transport object. This makes it possible to transport the transport object in a state in which the transport object is kept at a low temperature for a longer period of time.

The following will describe details of one or more embodiments of the present invention.

Embodiment 1

Figure 1A:
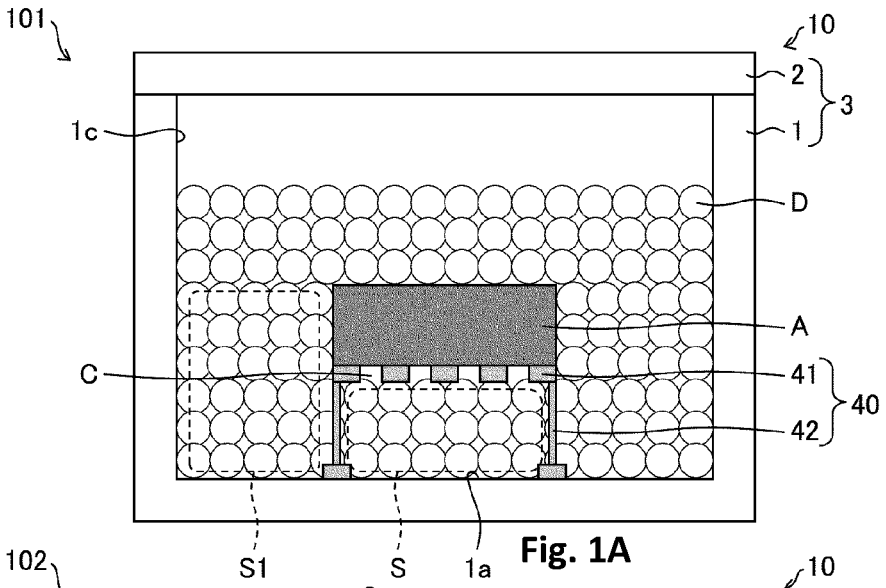
FIGS. 1A-C schematically illustrate a configuration of a low-temperature transport device in accordance with Embodiment 1 of one or more embodiments of the present invention. 101 of FIG. 1A is a cross-sectional view, 102 of FIG. 1B is a top view illustrating an inside of the device, and 103 of FIG. 1C is a cross-sectional view illustrating another configuration example of the device illustrated in 101 of FIG. 1A.
Figure 1B:
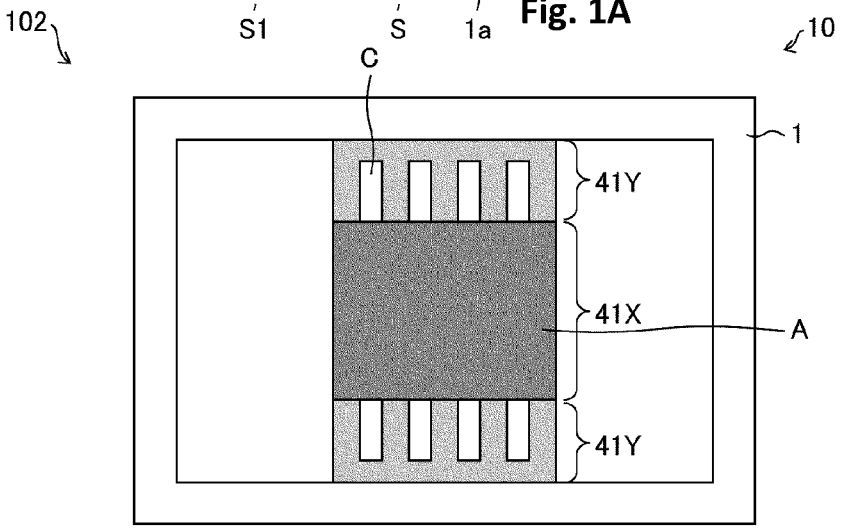
Figure 1C:
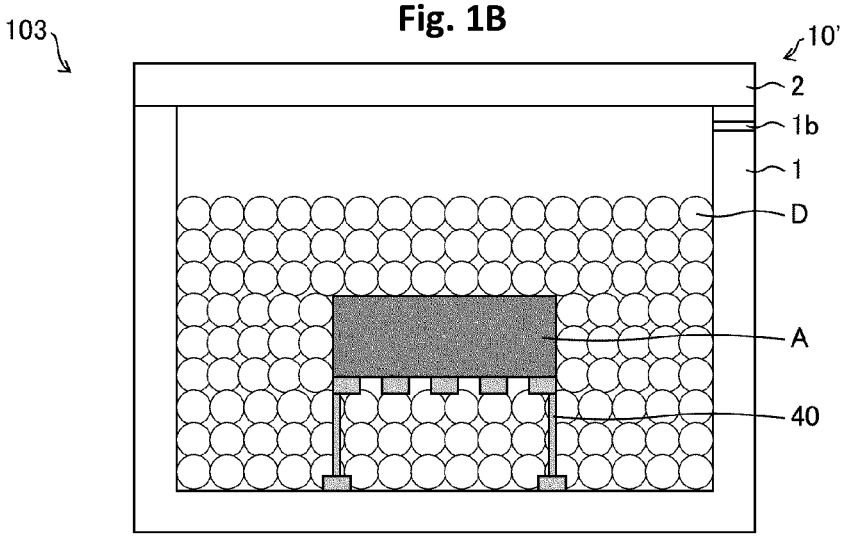

FIGS. 1A-C schematically illustrate a configuration of a low-temperature transport device 10 in accordance with Embodiment 1. 101 of FIG. 1A is a cross-sectional view, 102 of FIG. 1B is a top view illustrating an inside of the device, and 103 of FIG. 1C is a cross-sectional view illustrating another configuration example of the device illustrated in 101 of FIG. 1A. Note that in 102 of FIG. 1B, a lid 2 and dry ice D are not illustrated for simplification.

As illustrated in 101 and 102 of FIGS. 1A-B, the low-temperature transport device 10 in accordance with Embodiment 1 includes a thermal insulation container 3, the dry ice D, and a support member 40 for supporting a transport object A.

The thermal insulation container 3 has a rectangular shape and accommodates the transport object A, the dry ice D, and the support member 40. The thermal insulation container 3 is made of a heat insulating material. The thermal insulation container 3 includes a container body 1 and the lid 2 for closing an opening of the container body 1.

The transport object A is stored at a temperature ranging from, for example, −150° C. to −70° C. The transport object A is taken out of a place in which the transport object A is stored and is then accommodated in the low-temperature transport device 10. The accommodated transport object A is then transported to a site in which the transport object A is to be used. Examples of the transport object A include tissue from living organisms, microorganisms, viruses, products derived from living organisms, processed cells, and vaccines. Specifically, in a case where the transport object A is a vaccine, the low-temperature transport device in accordance with Embodiment 1 leads to reduction of the threat of infection by pathogenic viruses, and contributes to, for example, the achievement of Goal 3 ("Ensure healthy lives and promote well-being for all at all ages") among Sustainable Development Goals (SDGs).

The support member 40 is disposed inside the thermal insulation container 3. The support member 40 supports the transport object A so as to separate the transport object A from an inner bottom surface 1*a* of the thermal insulation container 3. The support member 40 includes a placement part 41 on which the transport object A is placed and a support column 42 extending from the placement part 41 to the inner bottom surface 1*a* of the thermal insulation container 3. This allows the transport object A on the placement part 41 to be fixed at a position separated from the inner bottom surface 1*a* of the thermal insulation container 3 even in a state in which the dry ice D is not disposed in the thermal insulation container 3. In addition, in the low-temperature transport device 10, a space S (first space) is formed between the transport object A supported by the support member 40 and the inner bottom surface 1*a* of the thermal insulation container 3.

As illustrated in 102 of FIG. 1B, the placement part 41 extends from one inner side surface of two mutually opposite inner side surfaces of the container body 1 to the other inner side surface thereof. In addition, two opposite ends of the placement part 41 in a direction in which the placement part 41 extends are close to the corresponding inner side surfaces of the container body 1. Thus, the placement part 41 includes a transport object placement area 41X and arm areas 41Y extending from the transport object placement area 41X to the inner side surfaces of the container body 1. The arm areas 41Y are in contact with the corresponding inner side surfaces of the container body 1, so that the distance between the side surfaces of the transport object A and the inner side surfaces of the container body 1 is kept constant even during transport of the transport object A. The arm areas 41Y have a function of keeping the distance between the transport object A and the inner side surfaces of the container body 1 constant.

The dry ice D is disposed in the thermal insulation container 3 in order to keep the transport object A cool. Specifically, an area between side walls of the thermal insulation container 3 and the side surfaces of the transport object A is filled with the dry ice D in the form of a pellet. Further, the space S is also filled with the dry ice D in the form of a pellet. The dry ice D is disposed on or around all outer surrounding surfaces, including a top surface, side surfaces, and a bottom surface, of the transport object A. In particular, the dry ice D may be disposed directly on all outer surrounding surfaces, including the top surface, side surfaces, and bottom surface, of the transport object A. That is, the dry ice D is disposed in heat transfer contact with all outer surfaces, which are the top surface, side surfaces, and bottom surface, of the transport object A. The expression "heat transfer contact" means a state in which the dry ice D is in contact with outer surfaces of the transport object A so that the dry ice D can cool the transport object A. Specific examples of the "heat transfer contact" state include (1) a state in which the dry ice D is in direct contact with the outer surfaces of the transport object A, (2) a state in which the dry ice D is in contact with the outer surfaces of the transport object A via a member capable of transferring heat, and (3) a state in which cool air from the dry ice D can come into contact with the outer surfaces of the transport object A.

As a structure representing the state (3), in a configuration illustrated in 101 and 102 of FIGS. 1A-B, a cavity C through which the upper and lower sides of the placement part 41 communicate with each other is formed. The cavity C is formed at least in the transport object placement area 41X of the placement part 41. According to such a configuration, the cool air from the dry ice D comes into contact with the bottom surface of the transport object A through the cavity C.

The temperature of the transport object A supported by the support member 40 tends to increase while the transport object A is in contact with an inner side surface 1*c* of the thermal insulation container 3. In light of this, in the low-temperature transport device 10, a space S1 (second space) may be formed between the transport object A supported by the support member 40 and the inner side surface 1*c* of the thermal insulation container 3. In the configuration illustrated in 101 of FIG. 1A, a partition member between the space S1 and the space S is not provided, and thus the space S1 and the space S communicate with each other. Alternatively, the low-temperature transport device 10 may be configured such that a partition member is provided in at least one area between the space S1 and the space S and has provided therein at least one hole through which the space S1 and the space S communicate with each other. In this case, the hole only need be large enough for the dry ice D to pass through. The partition member having such a hole provided therein is, for example, a net.

In addition, as illustrated in 101 of FIG. 1A, the dry ice D may be disposed on or around all outer surfaces, which are the top surface, side surfaces, and bottom surface, of the transport object A. In such a configuration, in a case where the transport object A has a rectangular parallelepiped shape, the space S1 is formed between all the four side surfaces of the transport object A and the inner side surfaces 1*c*.

In the low-temperature transport device 10, the dry ice D is in the form of a pellet. However, the dry ice D may be in any form that allows the dry ice D to be accommodated in the thermal insulation container 3 and that allows the transport object A to be kept cool. For example, the dry ice D may be in the form of a block or in the form of powder. Note that, although the dry ice D may be a large lump, the dry ice D may be a plurality of pieces of dry ice that are each in the form of a pellet, block, or powder in terms of a filling property. It is important to sufficiently fill the space S with the dry ice in the form of a pellet, block, or powder. Thus, a diameter of the dry ice D may be smaller than dimensions of the space S allocated in the container body 1. More specifically, the space S is allocated as the space between the placement part 41 and the inner bottom surface 1*a* and as the space between the support columns 42 adjacent to each other. Thus, the diameter of the dry ice D may be smaller than the distance between the placement part 41 and the inner bottom surface 1*a* or the distance between the support columns 42 adjacent to each other. In addition, even in a case where the dry ice D is larger than the dimension of the space S of the container body 1 at the beginning of filling of the dry ice D, the dry ice D may be configured to become smaller than the dimension of the space S by sublimating over time.

The dry ice in the form of a pellet, block, or powder may have a shape with few corners so that the dry ice easily rolls into the space S. In other words, the dry ice may have a shape with a curved surface protruding outward. Examples of the shape of the dry ice in the form of a pellet, block, or powder include a circularly columnar shape, a spherical shape, and a rice grain-like shape. The dry ice D may have a spherical shape, which is the easiest shape to roll.

Further, as illustrated in 103 of FIG. 1C, a low-temperature transport device 10' may include a ventilating path 1*b*. The ventilating path 1*b* is formed in the container body 1. The ventilating path 1*b* is a hole through which the outside and the inside of the thermal insulation container 3 communicate with each other. The ventilating path 1*b* is a hole for letting carbon dioxide generated by sublimation of the dry ice D escape from the thermal insulation container 3 to the outside. With the ventilating path 1*b*, it is possible to prevent breakage of the thermal insulation container 3 by pressure of the carbon dioxide generated from the dry ice D. The structure and position of the ventilating path 1*b* are not particularly limited, provided that the carbon dioxide generated from the dry ice D can escape from the thermal insulation container 3 to the outside. For example, the ventilating path 1*b* may be formed on the lid 2.

The structure that allows the carbon dioxide generated from the dry ice D to escape from the thermal insulation container 3 to the outside is not limited to the structure in which the ventilating path 1*b* is provided in the thermal insulation container 3. For example, the low-temperature transport device 10 illustrated in 101 and 102 of FIGS. 1A-B can achieve the structure that lets the carbon dioxide generated from the dry ice D escape from the thermal insulation container 3 to the outside. Specifically, such a structure is the structure that restricts the extent to which the container body 1 and the lid 2 fit each other so that the carbon dioxide generated from the dry ice D escapes from the thermal insulation container 3 to the outside. A clearance is provided at a part at which the container body 1 and the lid 2 are fitted to decrease the extent to which the container body 1 and the lid 2 fit each other. This allows a gap between the container body 1 and the lid 2 to be generated when the lid 2 is opened with respect to the container body 1 by the pressure of the carbon dioxide generated from the dry ice D. The carbon dioxide escapes from the thermal insulation container 3 to the outside through the clearance.

(Operation and Effect of Low-Temperature Transport Device 10 and Method for Performing Cool-Temperature Transport with Use of Low-Temperature Transport Device 10)

According to the configuration of the low-temperature transport device 10, the dry ice D is disposed on all the outer surrounding surfaces, including the top surface, side surfaces, and bottom surface, of the transport object A. Thus, the cool air of the dry ice D spreads all over the transport object A. This makes it possible to keep the transport object A at a low temperature for a long period of time. Each of 201 to 203 of FIGS. 2A-C is a view for describing an operation and effect of the low-temperature transport device 10. 201 of FIG. 2A is a view illustrating a state of the low-temperature transport device 10 at the beginning of transport of the transport object A. Each of 202 and 203 of FIGS. 2B-C is a view illustrating a state of the low-temperature transport device 10 during transport of the transport object A.

First, as illustrated in 201 of FIG. 2A, the dry ice D is in heat transfer contact with all the outer surfaces, which are the top surface, side surfaces, and bottom surface, of the transport object A in the low-temperature transport device 10 at the beginning of transport. Then, during transport of the transport object A, the dry ice D undergoes a phase change from a solid into a gas due to sublimation starting from the dry ice D in heat transfer contact with the transport object A.

Thus, as illustrated in 202 of FIG. 2B, the above-described sublimation forms a gap between the outer surfaces of the transport object A and the dry ice D. Then, other dry ice D is sequentially replenished (supplied) to the gap and disposed in the gap during the transport. Therefore, the dry ice D always keeps in heat transfer contact with the transport object A.

Here, in the low-temperature transport device 10 in accordance with Embodiment 1, even in a state in which the dry ice D is not disposed in the thermal insulation container 3, the transport object A on the placement part 41 is fixed at a position separated from the inner bottom surface 1*a* of the thermal insulation container 3. Further, in the low-temperature transport device 10, the space S is formed between the transport object A supported by the support member 40 and the inner bottom surface 1*a* of the thermal insulation container 3. Thus, even in a case where the dry ice D in contact with the bottom portion of the placement part 41 undergoes a phase change due to sublimation, the distance by which the placement part 41 and the inner bottom surface 1*a* are separated is kept. As a result, the phase change of the dry ice D does not change the volume of the space S.

Therefore, if a gap is formed between the placement part 41 and the dry ice D by the sublimation of the dry ice D, other dry ice D is supplied to the space S and is disposed in the gap (see 203 of FIG. 2C). During the transport, since the phase change of the dry ice D does not change the volume of the space S, the space S to be filled with the dry ice D is ensured. Thus, according to the low-temperature transport device 10, it is possible to stably supply the cool air of the dry ice D to a bottom surface of the transport object A. That is, Embodiment 1 may include a method for transporting a transport object A at a cool temperature with use of the low-temperature transport device 10, the method including a dry ice replenishing step of sequentially replenishing (supplying) dry ice D disposed in the container body 1 into a space (gap) formed by sublimation of the dry ice D with which the space S is filled.

In a case where the transport object A is not supported by the support member 40, and an area between the transport object A and the inner bottom surface 1*a* is filled with only the dry ice D, the distance between the transport object A and the inner bottom surface 1*a* decreases as the dry ice D sublimates. As a result, the space S to be filled with the dry ice D cannot be ensured during the transport, and the transport object A and the inner bottom surface 1*a* come into contact with each other. This leads to the absence of the dry ice D to be disposed on the bottom surface of the transport object A, and thus precludes the cool air generated from the dry ice D from being stably supplied.

In contrast, in the low-temperature transport device 10 in accordance with Embodiment 1, a position of the transport object A in the thermal insulation container 3 is determined by the support member 40 and thus is not dependent on the sublimation of the dry ice D. Therefore, the sublimation of the dry ice D does not cause the transport object A to be tilted. Note that regardless of the presence or absence of the dry ice D, a fixing member for fixing the transport object A to the support member 40 may be provided to the support member 40. Such a fixing member makes the transport object A unmovable on the support member 40. The above-described fixing member is, for example, a protruding member that protrudes upward from the placement part 41 of the support member 40. Further, the above-described fixing member may be an anti-slip member (for example, an anti-slip sheet and an anti-slip tape) provided on the support member 40. Still further, the above-described fixing member may be a member for covering the transport object A to fix the transport object A to the support member 40.

As described above, according to the low-temperature transport device 10 in accordance with Embodiment 1, the cool air of the dry ice D spreads all over the transport object A. This makes it possible to transport the transport object A in a state in which the transport object A is kept at a low temperature for a longer period of time.

Further, the dry ice D may be in a direct contact with all the outer surrounding surfaces, including the top surface, side surfaces, and bottom surface, of the transport object A until 24 hours have elapsed. However, the transport object A has an area covered with the support member 40 (for example, the bottom surface of the transport object A). Therefore, it is sufficient that half or more of the entire surface area, which is the area of the top surface, side surfaces, and bottom surface, of the transport object A is in a direct contact with the dry ice D.

(Method for Producing Low-Temperature Transport Device 10)

The following will describe a method for producing the low-temperature transport device 10. Each of 301 to 303 of FIGS. 3A-C is a cross-sectional view illustrating an example of a method for producing the low-temperature transport device 10. A method for producing the low-temperature transport device 10 in accordance with Embodiment 1 includes an installing step and a dry ice disposing step. Further, the method may include a closing step.

First, as illustrated in 301 of FIG. 3A, in the installing step, the support member 40 and the transport object A are installed in the container body 1, so that the space S is formed between the transport object A and the inner bottom surface 1*a* of the container body 1. Specifically, the support member 40 is disposed such that the placement part 41 and the inner bottom surface 1*a* are separated, and that the support column 42 is in contact with the inner bottom surface 1*a*. Then, the transport object A stored at a predetermined temperature is taken out of a storage, and is placed onto the placement part 41 of the support member 40 disposed in the container body 1. As described above, in a production method in accordance with Embodiment 1, mere placement of the transport object A onto the placement part 41 of the support member 40 fixes a position of the transport object A in the container body 1. Therefore, variations among individuals who perform a storing operation are less likely to occur in the position of the transport object A in the container body 1, and it is thus possible to decrease variations in the position of the transport object A with respect to the container body 1 among the manufacturers of the low-temperature transport device 10. As a result, it is possible to decrease the variations in the property of keeping the transport object A at a low temperature among the manufacturers of the low-temperature transport device 10, and it is possible to stably keep the transport object A at a low temperature.

Subsequently, in the dry ice disposing step, as illustrated in 302 of FIG. 3B, the space S is filled with the dry ice D so as to cool the transport object A. Further, in the dry ice disposing step, the dry ice D is disposed around the transport object A in the container body 1. In this case, the dry ice D is disposed so as to be in heat transfer contact with the outer surfaces, including the side surfaces, top surface, and bottom surface, of the transport object A. Note that, as is apparent from 302 of FIG. 3B, the container body 1 is filled with the dry ice D such that the dry ice D is in heat transfer contact with the top surface of the transport object A.

Subsequently, in the closing step, as illustrated in 303 of FIG. 3C, the opening of the container body 1 in which the support member 40, the transport object A, and the dry ice D are disposed is closed with the lid 2. As a result, the thermal insulation container 3 is constituted by the container body 1 and the lid 2, and the low-temperature transport device 10 that accommodates, in the thermal insulation container 3 thereof, the support member 40, the transport object A, and the dry ice D is achieved.

Note that, according to the method for producing the low-temperature transport device 10 in accordance with Embodiment 1, in the installing step, the support member 40 may be disposed such that the placement part 41 and the inner side surface 1*c* are separated. With the support member 40 disposed in such a manner, the space S1 is formed between the transport object A placed on the placement part 41 of the support member 40 and the inner side surface 1*c*. Therefore, in the dry ice disposing step, the dry ice D can be smoothly disposed into the space S through the space S1.

(Dimensions of Spaces S and S1)

The space S is formed between the transport object A supported by the support member 40 and the inner bottom surface 1*a* of the thermal insulation container 3. Further, the space S1 is formed between the transport object A supported by the support member 40 and the inner side surface 1*c* of the thermal insulation container 3.

The dimensions of the spaces S and S1 may be any dimensions that are suitable for the cool air of the dry ice D to spread all over the transport object A, and may be set as appropriate according to, for example, the size of the transport object A, the size of the container body 1, and the shape and volume of the dry ice D.

For example, the distance between the transport object A and the inner bottom surface 1*a*, which is one of the dimensions that define the space S, may be not less than 5 mm and not more than 300 mm, not less than 10 mm and not more than 100 mm, or not less than 20 mm and not more than 50 mm. In addition, the distance between the transport object A and the inner side surface 1*c*, which is one of the dimensions that define the space S1, may be not less than 3 mm and not more than 400 mm, not less than 10 mm and not more than 250 mm, or not less than 15 mm and not more than 200 mm.

Variation 1

In the configuration of the low-temperature transport device in accordance with Embodiment 1, the following will describe a Variation of the configuration illustrated in 101 and 102 of FIGS. 1A-B. FIGS. 4A-B schematically illustrate a configuration of a low-temperature transport device 10A as Variation 1, 401 of FIG. 4A is a cross-sectional view, and 402 of FIG. 4B is a top view illustrating an inside of the device. Note that the lid 2 and the dry ice D are not illustrated in 401 and 402 of FIGS. 4A-B for simplification.

As illustrated in 401 and 402 of FIGS. 4A-B, the low-temperature transport device 10A has a configuration differing from the configuration illustrated in 101 and 102 of FIGS. 1A-B in terms of a configuration of a support member 40A. The support member 40A includes support columns 42A and two placement parts 41A. As illustrated in 402 of FIG. 4B, the placement parts 41A are linear boards. Further, the two placement parts 41A, which are the linear boards, cross each other and are connected with each other. Each placement part 41A is disposed along a diagonal line that connects one corner at which the adjacent side surfaces of the container body 1 are connected and another corner located opposite to the one corner. Further, the support columns 42A extend from both ends of each placement part 41A in a direction of the diagonal line toward the inner bottom surface 1*a* of the container body 1.

In addition, in the low-temperature transport device 10A, an area at which the two placement parts 41A intersect is the transport object placement area, and an area other than the area at which the two placement parts 41A intersect is the arm area.

The configuration of the low-temperature transport device 10A of Variation 1 also allows the cool air of the dry ice D to spread all over the transport object A. Thus, it is possible to keep the transport object A at a low temperature for a longer period of time.

Variation 2

In the configuration of the low-temperature transport device in accordance with Embodiment 1, the following will describe another Variation of the configuration illustrated in 101 and 102 of FIGS. 1A-B. FIGS. 5A-B schematically illustrate a configuration of a low-temperature transport device 10B as Variation 2. 501 of FIG. 5A is a cross-sectional view, and 502 of FIG. 5B is a top view illustrating an inside of the device. Note that in 501 and 502 of FIGS. 5A-B, the lid 2 and the dry ice D are not illustrated for simplification.

As illustrated in 501 and 502 of FIGS. 5A-B, the low-temperature transport device 10B has a configuration differing from the configuration illustrated in 101 and 102 of FIGS. 1A-B in terms of a configuration of a support member 40B. The support member 40B includes placement parts 41B and support columns 42B. The placement parts 41B include two linear portions 43 disposed parallel to each other. Each linear portion 43 extends from one inner side surface of two mutually opposite inner side surfaces of the container body 1 to the other inner side surface thereof. Further, both ends of each of the linear portions 43 in a direction in which each of the linear portions 43 extends are close to the corresponding inner side surfaces of the container body 1. The support columns 42B extend from the linear portions 43 toward the inner bottom surface 1*a*.

In addition, a distance between the two linear portions 43 is smaller than a dimension of the transport object A in one direction of the transport object A. This allows the transport object A to be placed onto the two linear portions 43 separated from each other. Further, the two linear portions 43 have recesses 43*a* that are provided in areas where the transport object A is to be placed and that are formed such that both the side surfaces and the bottom surface of the transport object A are fitted into the recesses 43*a*.

Further, in the low-temperature transport device 10B, the recesses 43*a* are the transport object placement area, and an area other than the recesses 43*a* is the arm area. In the low-temperature transport device 10B, the transport object A is fitted into the recesses 43*a*, so that the transport object A is positioned in the container body 1 more firmly.

The configuration of the low-temperature transport device 10B of Variation 2 also allows the cool air of the dry ice D to spread all over the transport object A. Thus, it is possible to keep the transport object A at a low temperature for a longer period of time.

Variation 3

In the configuration of the low-temperature transport device in accordance with Embodiment 1, the following will describe still another Variation of the configuration illustrated in 101 and 102 of FIGS. 1A-B. FIGS. 6A-B schematically illustrate a configuration of a low-temperature transport device 10C as Variation 3. 601 of FIG. 6A is a cross-sectional view, and 602 of FIG. 6B is a top view illustrating an inside of the device. Note that in 601 and 602 of FIGS. 6A-B, the lid 2 and the dry ice D are not illustrated for simplification.

As illustrated in 601 and 602 of FIGS. 6A-B, the low-temperature transport device 10C has a configuration differing from the configuration illustrated in 101 and 102 of FIGS. 1A-B in terms of a configuration of a support member 40C. The support member 40C includes a placement part 41C and a support column 42C. The placement part 41C has a configuration similar to that of the placement part 41 illustrated in 101 and 102 of FIGS. 1A-B. More specifically, the placement part 41C extends from one inner side surface of two mutually opposite inner side surfaces of the container body 1 to the other inner side surface thereof. In addition, both ends of the placement part 41C in a direction in which the placement part 41C extends are close to the corresponding inner side surfaces of the container body 1. The single support column 42C is a single support column formed with respect to such a placement part 41C. The support column 42C extends from a center of the placement part 41C to the inner bottom surface 1*a*.

The configuration of the low-temperature transport device 10C of Variation 3 also allows the cool air of the dry ice D to spread all over the transport object A. Thus, it is possible to keep the transport object A at a low temperature for a longer period of time.

Note that in the low-temperature transport device 10C of Variation 3, the number of the support column 42C is not limited to one. The number of the support column 42C may be more than one. In this case, a plurality of support columns 42C are aligned in a row on the middle of the placement part 41C such that the plurality of support columns 42C are separated from each other.

Embodiment 2

The following will describe one or more embodiments of the present invention. Note that, for convenience, members identical in function with members described in Embodiment 1 will be given identical reference signs, and description of such members will be omitted.

FIGS. 7A-B schematically illustrate a configuration of a low-temperature transport device 11 in accordance with Embodiment 2. 701 of FIG. 7A is a cross-sectional view, and 702 of FIG. 7B is a top view illustrating an inside of the device. Note that in 701 and 702 of FIGS. 7A-B, the lid 2 and the dry ice D are not illustrated for simplification.

The low-temperature transport device 11 in accordance with Embodiment 2 differs from Embodiment 1 in that the low-temperature transport device 11 includes inclined members 5. As illustrated in 701 and 702 of FIGS. 7A-B, the inclined members 5 are two inclined members that are provided on the inner bottom surface 1*a* of the container body 1 and that are disposed such that the support member 40 is interposed between the two inclined members. The inclined members 5 each have slopes 5*a*. The slopes 5*a* are surfaces inclined down to the space S.

According to the configuration of the low-temperature transport device 11, the dry ice D is easily supplied into the space S by sliding over the slopes 5*a* of the inclined members 5, when the space S is filled with dry ice D (the dry ice disposing step) at the manufacture of the low-temperature transport device 11 so as to cool the transport object A. That is, the slopes 5*a* of the inclined members 5 have a function as a guiding path for guiding the dry ice D into the space S. This simplifies the filling operation of the dry ice D in the dry ice disposing step, and thus makes it possible to further decrease variations in the property of keeping the transport object A at a low temperature among the manufacturers of the low-temperature transport device 10. This makes it possible to stably keep the transport object A at a low temperature.

In addition, even when a gap is formed between the placement part 41 and the dry ice D due to the sublimation of the dry ice D, other dry ice D is smoothly supplied into the space S via the slopes 5*a* of the inclined members 5. Therefore, the low-temperature transport device 11 makes it possible to supply the cool air more stably from the dry ice D to the bottom surface of the transport object A.

Variation 4

In the configuration of the low-temperature transport device in accordance with Embodiment 2, the following will describe Variation of the configuration illustrated in 701 and 702 of FIGS. 7A-B. FIGS. 8A-B schematically illustrate the configuration of a low-temperature transport device 11A as Variation 4. 801 of FIG. 8A is a cross-sectional view, and 802 of FIG. 8B is a top view illustrating an inside of the device. Note that in 801 and 802 of FIGS. 8A-B, the lid 2 and the dry ice D are not illustrated for simplification.

As illustrated in 801 and 802 of FIGS. 8A-B, the low-temperature transport device 11A has a configuration differing from the configuration illustrated in 701 and 702 of FIGS. 7A-B in terms of a configuration of a support member 40D and an arrangement of the inclined member 5. In the low-temperature transport device 11A, the inclined member 5 is only one inclined member that is provided on the inner bottom surface 1*a* of the container body 1 and that is disposed on one side of the support member 40. Further, the inclined member 5 has the slope 5*a* that is inclined down to the space S.

In addition, in a top view illustrated in 802 of FIG. 8B, the support member 40D is disposed such that a placement part 41D partly overlaps the inclined member 5. Further, as illustrated in 801 of FIG. 8A, support columns 42$D_1$ and 42$D_2$ extend from the placement part 41D to the inner bottom surface 1*a*. Extending portions of the support columns 42$D_1$ and 42$D_2$ are provided parallel to each other. The support column 42$D_1$ has, at an end thereof on a side opposite from the placement part 41D, an end surface provided along the inner bottom surface 1*a*. On the other hand, the support column 42$D_2$ has, at an end thereof on a side opposite from the placement part 41D, an end surface that is provided along the slope 5*a* of the inclined member 5.

The configuration of the low-temperature transport device 11A of Variation 4 also allows the cool air of the dry ice D to spread all over the transport object A. Thus, it is possible to keep the transport object A at a low temperature for a longer period of time.

Variation 5

In the configuration of the low-temperature transport device in accordance with Embodiment 2, the following will describe still another Variation of the configuration illustrated in 701 and 702 of FIGS. 7A-B. FIGS. 9A-B schematically illustrate a low-temperature transport device 11B as Variation 5. 901 of FIG. 9A is a cross-sectional view, and 902 of FIG. 9B is a top view illustrating an inside of the device. Note that in 901 and 902 of FIGS. 9A-B, the lid 2 and the dry ice D are not illustrated for simplification.

As illustrated in 901 and 902 of FIGS. 9A-B, the low-temperature transport device 11B has a configuration differing from the configuration illustrated in 701 and 702 of FIGS. 7A-B in terms of a configuration and an arrangement of a support member 40E and an arrangement of the inclined member 5. In the low-temperature transport device 11B, the support member 40 is disposed in contact with one inner side surface among the four inner side surfaces of the container body 1. In addition, the inclined member 5 is disposed in contact with an inner side surface facing the inner side surface that is in contact with the support member 40 in the container body 1. The inclined member 5 has the slope 5*a* that is inclined down to the space S.

In a top view illustrated in 902 of FIG. 9B, the support member 40E is disposed such that a placement part 41E partly overlaps the inclined member 5. Further, as illustrated in 901 of FIG. 9A, support columns 42$E_1$ and 42$E_2$ extend from the placement part 41E to the inner bottom surface 1*a*. Extending portions of the support columns 42$E_1$ and 42$E_2$ are disposed parallel to each other. The support column 42$E_1$ has, at an end thereof on a side opposite from the placement part 41E, an end surface provided along the inner bottom surface 1*a*. On the other hand, the support column 42$E_2$ has, at an end thereof on a side opposite from the placement part 41E, an end surface provided along the slope 5*a* of the inclined member 5.

The configuration of the low-temperature transport device 11B of Variation 5 also allows the cool air of the dry ice D to spread all over the transport object A. Thus, it is possible to keep the transport object A at a low temperature for a longer period of time.

Variation 6

In the configuration of the low-temperature transport device in accordance with Embodiment 2, the following will describe yet another Variation of the configuration illustrated in 701 and 702 of FIGS. 7A-B. FIGS. 10A-B schematically illustrate a configuration of a low-temperature transport device 11C as Variation 6. 1001 of FIG. 10A is a cross-sectional view, and 1002 of FIG. 10B is a top view illustrating an inside of the device. Note that in 1001 and 1002 of FIGS. 10A-B, the lid 2 and the dry ice D are not illustrated for simplification.

As illustrated in 1001 and 1002 of FIGS. 10A-B, the low-temperature transport device 11C has a configuration differing from the configuration illustrated in 701 and 702 of FIGS. 7A-B in terms of a shape of dry ice D1. In the low-temperature transport device 11C, the dry ice D1 is in the form of a pellet and has a spherical shape or a circularly columnar shape with few corners. Dry ice D1 having a shape with few corners is easy to roll into the space S.

The configuration of the low-temperature transport device 11C of Variation 6 also allows the cool air of the dry ice D1 to spread all over the transport object A. Thus, it is possible to keep the transport object A at a low temperature for a longer period of time.

In particular, the dry ice D1 has a spherical or columnar shape, so that the dry ice D1 easily rolls on the slope 5*a* of the inclined member 5. Therefore, the low-temperature transport device 11C of Variation 6 makes it possible to more smoothly supply the dry ice D1 into the space S.

Variation 7

In the configuration of the low-temperature transport device in accordance with Embodiment 2, the following will describe still another Variation of the configuration illustrated in 701 and 702 of FIGS. 7A-B. FIGS. 11A-B schematically illustrate a configuration of a low-temperature transport device 11D as Variation 7. 1101 of FIG. 11A is a cross-sectional view, and 1102 of FIG. 11B is a top view illustrating an inside of the device. Note that in 1101 and 1102 of FIGS. 11A-B, the lid 2 and the dry ice D are not illustrated for simplification.

As illustrated in 1101 and 1102 of FIGS. 11A-B, the low-temperature transport device 11D has a configuration differing from the configuration illustrated in 701 and 702 of FIGS. 7A-B in terms of a shape of dry ice D2. In the low-temperature transport device 11D, the dry ice D2 is in the form of a pellet and has a rectangular parallelepiped shape.

The configuration of the low-temperature transport device 11D of Variation 7 also allows the cool air of the dry ice D2 to spread all over the transport object A. Thus, it is possible to keep the transport object A at a low temperature for a longer period of time.

<Specific Configuration of Low-Temperature Transport Device>

The following will describe a specific configuration of the low-temperature transport device with reference to FIG. 12. FIG. 12 is a cross-sectional view illustrating a specific configuration of the low-temperature transport device.

The low-temperature transport device illustrated in FIG. 12 features the structure of a support member 40F. Thus, the descriptions of the thermal insulation container 3, the inclined member 5, the transport object A, and the dry ice D are omitted here.

As illustrated in FIG. 12, the support member 40F includes a support member main body having a placement part 41F and a support column 42F, an extension member 44, and side surface fixing portions 45 and 46. The extension member 44 is detachably provided to the support member main body.

The extension member 44 extends between two corresponding inner side surfaces of the thermal insulation container 3. One end of the extension member 44 is in contact with one inner side surface of the two corresponding inner side surfaces of the thermal insulation container 3, and the other end of the extension member 44 is in contact with the other inner side surface of the two corresponding inner side surfaces of the thermal insulation container 3. This allows the extension member 44 to be in contact with the inner side surfaces of the container body 1, so that the distance between the side surfaces of the transport object A and the inner side surfaces of the container body 1 is kept constant even during transport of the transport object A.

In addition, the side surface fixing portions 45 are provided so as to be integral with the support member main body. As the side surface fixing portions 45, two side surface fixing portions are provided. Each side surface fixing portion 45 is shaped like a plate extending upward from the inner bottom surface 1*a* and is parallel to side surfaces of the transport object A placed on the placement part 41F. The two plate-shaped side surface fixing portions 45 are configured to sandwich the two mutually opposite side surfaces of the transport object A therebetween. In addition, the side surface fixing portion 46 holds the two mutually opposite side surfaces of the transport object A. This allows the side surfaces of the transport object A to be in contact with the side surface fixing portions 45 and 46, so that a position of the transport object A is fixed with respect to the transport object placement area 41X even during transport of the transport object A. In addition, in the low-temperature transport device illustrated in FIG. 12, the side surfaces of the transport object A are in heat transfer contact with the dry ice D through the side surface fixing portions 45 and 46.

According to the configuration of the low-temperature transport device illustrated in FIG. 12, the cool air of the dry ice D spreads all over the transport object A. Thus, it is possible to keep the transport object A at a low temperature for a longer period of time.

Note that the low-temperature transport device illustrated in FIG. 12 includes the inclined member 5. However, the configuration of the low-temperature transport device is not limited to this configuration, but may be a configuration in which the inclined member 5 is not included.

In the specific configuration of the low-temperature transport device, the following will describe a Variation of the configuration illustrated in FIG. 12. FIGS. 13A-B illustrate a Variation of the low-temperature transport device illustrated in FIG. 12. 1301 of FIG. 13A is a perspective view, and 1302 of FIG. 13B is a top view.

As illustrated in 1301 and 1302 of FIGS. 13A-B, a support member 40G has a configuration differing from the configuration illustrated in FIG. 12 in that the support member 40G includes a top surface support member 47 instead of the extension member 44. The top surface support member 47 is a U-shaped plate and has a lower end portion that comes into linear contact with the top surface of the transport object A.

The side surface fixing portions 45 each have a first insertion groove for the top surface support member 47 to be inserted. In addition, the top surface support member 47 has a second insertion groove for the side surface fixing portion 46 to be inserted. In the support member 40G, the side surface fixing portions 45, the side surface fixing portion 46, and the top surface support member 47 are fit together by insertion of the top surface support member 47 into the first insertion groove and insertion of the side surface fixing portion 46 into the second insertion groove. This brings the side surfaces of the transport object A into contact with the side surface fixing portions 45 and 46 and brings the top surface of the transport object A into contact with the top surface support member 47. This, therefore, prevents the transport object A from moving with respect to the support member 40G and prevents the transport object A from being tilted even during transport of the transport object A.

<Thermal Insulation Container 3>

The thermal insulation container 3 may be made of foamed plastic. In other words, the thermal insulation container 3 is constituted by foamed plastic.

Foamed plastic has an advantage in that the foamed plastic is light and less expensive and can prevent dew condensation. Specific examples of the foamed plastic include foamed polyurethane, foamed polystyrene, foamed polyethylene, foamed polypropylene, foamed poly(3-hydroxyalkanoate)-based resin, foamed acrylonitrile-styrene copolymer (AS) resin, and foamed acrylonitrile-butadiene-styrene copolymer (ABS) resin. Examples include the foamed poly(3-hydroxyalkanoate)-based resin.

Furthermore, the poly(3-hydroxyalkanoate)-based resin used for the thermal insulation container 3 may be at least one selected from the group consisting of poly(3-hydroxybutyrate-co-3-hydroxyhexanoate) (PHBH), poly(3-hydroxybutyrate) (P3HB), poly(3-hydroxybutyrate-co-3-hydroxyvalerate) (PHBV), poly(3-hydroxybutyrate-co-4-hydroxybutyrate) (P3HB4HB), poly(3-hydroxybutyrate-co-3-hydroxyoctanoate), and poly(3-hydroxybutyrate-co-3-hydroxyoctadecanoate). Further, examples of a foamed molded product of the poly(3-hydroxyalkanoate)-based resin include a foamed molded product of expanded particles disclosed in WO2019/146555A1. Note that the above-described poly(3-hydroxyalkanoate)-based resin can also be used in combination with, for example, another biodegradable resin such as polylactic acid and polybutylene succinate.

The use of biodegradable resins as described above can reduce the production of wastes of plastics. This can contribute to, for example, the achievement of Sustainable Development Goals (SDGs) such as Goal 12 "Ensure sustainable consumption and production patterns" and Goal 14 "Conserve and sustainably use the oceans, seas and marine resources for sustainable development".

Constituting the thermal insulation container 3 by a foamed plastic has an advantage in achieving reduction in weight of the entire low-temperature transport device 10.

<Component Material of Support Member 40>

A material constituting the support member 40 may be any material that is strong enough to support the transport object A and may be either a thermally conductive material or a thermally non-conductive material. The support member 40 may be constituted by plastic.

Examples of the plastic constituting the support member 40 include polyethylene, polypropylene, polyethylene terephthalate, polycarbonate, and polyvinyl chloride.

<Other Members and Materials>

The low-temperature transport device 10 in accordance with the present embodiments may further include a heat storage material as necessary. That is, the low-temperature transport device 10 may be configured to use both the dry ice D and the heat storage material in combination. The heat storage material may be disposed at any place in the low-temperature transport device 10. The heat storage material as used herein includes a cold storage material as well as the heat storage material itself. That is, a storage material used in the present embodiments includes at least one selected from the group consisting of a heat storage material and a cold storage material. The heat storage material or cold storage material is a plastic container, film bag, or the like in which a heat storage component or cold storage component is sealed.

In addition, the heat storage material may be at least one selected from the group consisting of a latent-heat typed heat storage material and a latent-heat typed cold storage material. A composition constituting the heat storage component or cold storage component of the latent-heat type heat storage material is not particularly limited, and can be, for example, any of the compositions disclosed in International Publication No. WO2014/125878, International Publication No. WO2019/151074, International Publication No. WO2016/068256, International Publication No. WO2019/172260, International Publication No. WO2018/180506, and others.

One or more embodiments of the present invention are not limited to each of the above-described embodiments, but can be altered by a skilled person in the art within the scope of the claims. One or more embodiments of the present invention also include, in its technical scope, any embodiment derived by combining technical means disclosed in differing embodiments.

Aspects of one or more embodiments of the present invention can also be summarized as follows:

A low-temperature transport device 10 in accordance with Aspect 1 of one or more embodiments of the present invention includes: a thermal insulation container 3 including a container body 1 and a lid 2 for closing an opening of the container body 1; dry ice D disposed in the thermal insulation container 3 so as to cool a transport object A; a support member 40 disposed in the thermal insulation container 3 to support the transport object A; and a first space S formed between the transport object A supported by the support member 40 and an inner bottom surface 1*a* of the thermal insulation container 3, the first space S being filled with the dry ice D.

In Aspect 2 of one or more embodiments of the present invention, the low temperature transport device 11 is configured, in Aspect 1, to include at least one inclined member 5 having a slope 5*a* inclined down to the space S.

In Aspect 2 of one or more embodiments of the present invention, the low temperature transport device 10 and/or 11 is configured such that, in Aspect 1, the dry ice D is in a form of a pellet.

In Aspect 3 of one or more embodiments of the present invention, the low temperature transport device 10 and/or 11 is configured such that, in Aspect 1 or 2, the dry ice D and/or D1 has a spherical shape or a circularly columnar shape.

In Aspect 4 of one or more embodiments of the present invention, the low temperature transport device 11 is configured, in any one of Aspects 1 to 3, to further include at least one inclined member 5 having a slope 5*a* inclined down to the space S.

In Aspect 5 of one or more embodiments of the present invention, the low temperature transport device 10 is configured, in any one of Aspects 1 to 4, to further include a second space S1 formed between the transport object A supported by the support member 40 and an inner side surface 1*c* of the thermal insulation container 3.

In Aspect 6 of one or more embodiments of the present invention, the low temperature transport device 10 is configured such that, in any one of Aspects 1 to 5, the dry ice D is disposed on or around all outer surrounding surfaces, including a top surface, side surfaces, and a bottom surface, of the transport object A.

A method for producing a low-temperature transport device in accordance with Aspect 7 of one or more embodiments of the present invention is a method for producing the low temperature transport device 10 and/or 11 in accordance with any one of Aspects 1 to 6, the method including: an installing step of installing the support member 40 and the transport object A in the container body 1 to form a first space S between the transport object A and the inner bottom surface 1*a* of the container body 1; and a dry ice disposing step of filling the first space S with dry ice D. It is more preferable that the method further includes a step of disposing the dry ice D on or around the transport object A in the container body 1 and an closing step of closing, with use of the lid 2, an opening of the container body 1 in which the support member 40, the transport object A, and the dry ice D are disposed.

In Aspect 8 of one or more embodiments of the present invention, a method for producing a low-temperature transport device is such that, in Aspect 7, in the dry ice disposing step, the dry ice D is disposed on or around all outer surrounding surfaces, including a top surface, side surfaces, and a bottom surface, of the transport object A.

A method in accordance with Aspect 9 of one or more embodiments of the present invention is a method for transporting a transport object A at a low temperature with use of the low-temperature transport device 10 and/or 11 in accordance with any one of Aspects 1 to 6, the method including a dry ice replenishing step of sequentially replenishing dry ice D disposed in the container body 1 into a space formed by sublimation of the dry ice D with which the space S is filled.

In Aspect 10 of one or more embodiments of the present invention, the method is such that, in Aspect 9, in the dry ice replenishing step, the dry ice D is disposed on or around all outer surrounding surfaces, including a top surface, side surfaces, and a bottom surface, of the transport object A.

Examples

Low-temperature transport devices having device configurations (i) to (iv) illustrated in FIGS. 14B-E were made. With regard to each device configuration, a transport object was set, and a thermal insulation container was filled with 10 kg of dry ice. Further, for each of the device configurations (i) to (iv), an internal temperature of the thermal insulation container was measured, and a change in the internal temperature over time was examined.

The device configurations (i) and (ii) correspond to Examples. The device configuration (i) is similar to the low-temperature transport device illustrated in FIG. 12. The device configuration (ii) is the configuration of the low-temperature transport device illustrated in FIG. 12 from which the inclined member 5 is removed. In the device configuration (ii), a space is formed between the transport object A and the inner side surfaces of the thermal insulation container 3, in addition to the space formed, in the configuration illustrated in FIG. 12, between the transport object A and the inner bottom surface of the thermal insulation container 3.

The device configurations (iii) and (iv) in which a support member is not included correspond to Comparative Examples. In the device configuration (iii), a thermal insulation container is filled with dry ice in a state in which a bottom surface of a transport object and an inner bottom surface of the thermal insulation container are in contact with each other. In the device configuration (iv), a top portion of a transport object is exposed from the dry ice with which the thermal insulation container is filled.

Figure 14A:
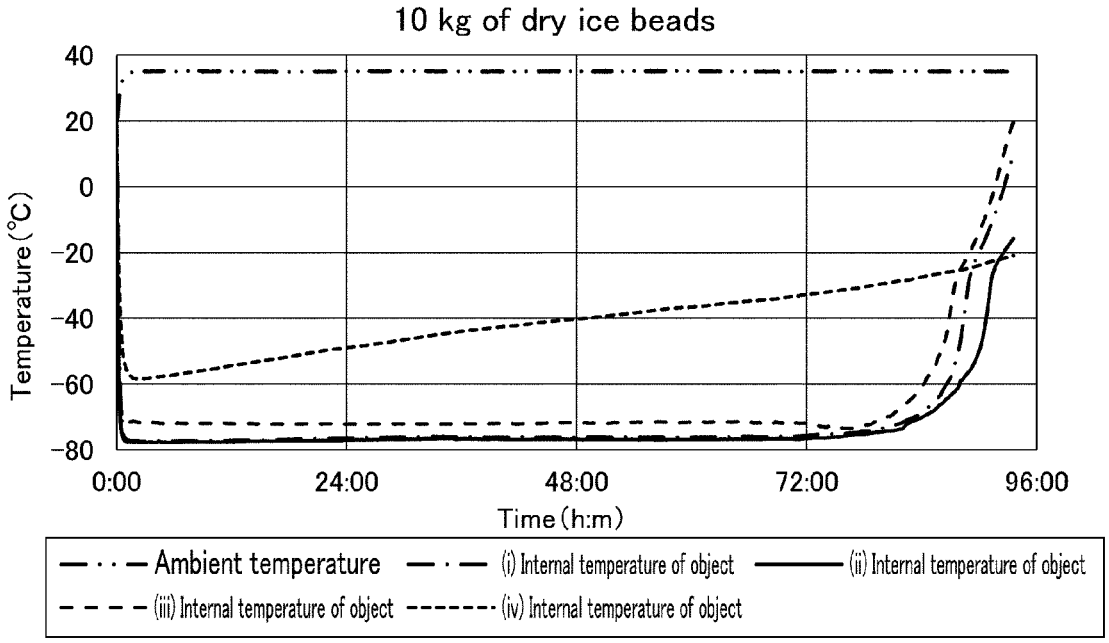
Figure 14B:
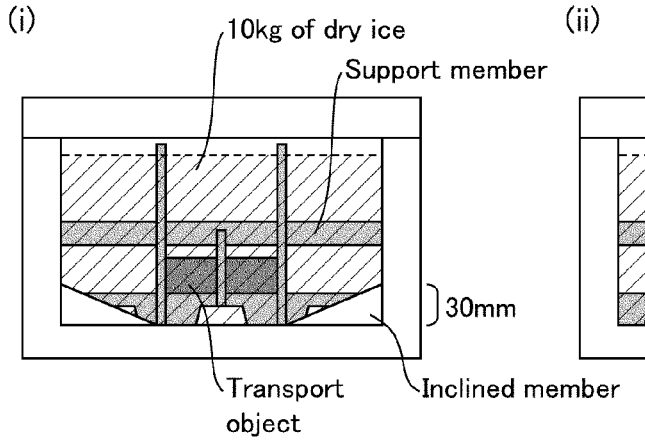
Figure 14C:
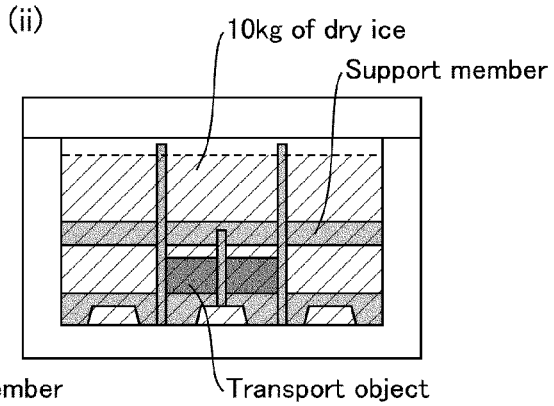
Figure 14D:
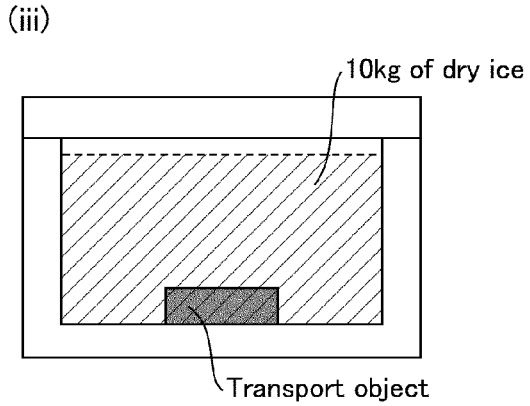
Figure 14E:
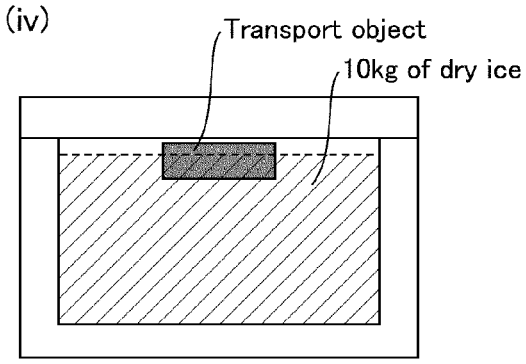

As shown in a graph of FIG. 14A, the low-temperature transport devices having the device configurations (i) and (ii) can stably keep the internal temperature of the thermal insulation container at a low temperature for a long period of time as compared to the low-temperature transport devices having the device configurations (iii) and (iv).

REFERENCE SIGNS LIST

1 Container body

1*a* Inner bottom surface

2 Lid

3 Thermal insulation container

5 Inclined member

5*a* Slope

10, 10', 10A to 10C Low-temperature transport device

11, 11A to 11D Low-temperature transport device

40, 40A to 40F Support member

41, 41A to 41F Placement part
42, 42A to 42F Support column
A Transport object
D, D1, D2 Dry ice
S Space (first space)
S1 Space (second space)

Although the disclosure has been described with respect to only a limited number of embodiments, those skilled in the art, having benefit of this disclosure, will appreciate that various other embodiments may be devised without departing from the scope of the present disclosure. Accordingly, the scope of the invention should be limited only by the attached claims.

The invention claimed is:

1. A low-temperature transport device comprising:
a thermal insulation container including a container body and a lid for closing an opening of the container body;
dry ice disposed in the thermal insulation container so as to cool a transport object;
a support member disposed in the thermal insulation container to support the transport object;
a first space formed between the transport object supported by the support member and an inner bottom surface of the thermal insulation container; and
a second space formed between the transport object supported by the support member and an inner side surface of the thermal insulation container,
the first space and the second space communicating with each other,
the first space being filled with the dry ice, and
the dry ice existing in the second space.

2. The low-temperature transport device according to claim 1, wherein the dry ice is in a form of a pellet.

3. The low-temperature transport device according to claim 1, wherein the dry ice is shaped with few corners.

4. The low-temperature transport device according to claim 1, further comprising at least one inclined member having a slope inclined down to the space.

5. The low-temperature transport device according to claim 1, wherein the dry ice is disposed on or around all outer surrounding surfaces, including a top surface, side surfaces, and a bottom surface, of the transport object.

6. A method for producing the low-temperature transport device according to claim 1, the method comprising:
an installing step of installing the support member and the transport object in the container body to form the first space between the transport object and the inner bottom surface of the container body; and
a dry ice disposing step of filling the first space with dry ice.

7. The method according to claim 6, wherein in the dry ice disposing step, the dry ice is disposed on or around all outer surrounding surfaces, including a top surface, side surfaces, and a bottom surface, of the transport object.

8. A method for transporting a transport object at a low temperature with the low-temperature transport device according to claim 1, the method comprising:
a dry ice replenishing step of sequentially replenishing dry ice disposed in the container body into a space formed by sublimation of the dry ice with which the space is filled.

9. The method according to claim 8, wherein in the dry ice replenishing step, the dry ice is disposed on or around all outer surrounding surfaces, including a top surface, side surfaces, and a bottom surface, of the transport object.

10. The low-temperature transport device according to claim 1, wherein half or more of an entire surface area of the transport object, which is an area of a top surface, a side surface, and a bottom surface of the transport object, is in a direct contact with the dry ice.

* * * * *